United States Patent [19]

Kuse et al.

[11] Patent Number: 5,002,859

[45] Date of Patent: Mar. 26, 1991

[54] METHOD OF FORMING COLOR PHOTOGRAPHIC IMAGES

[75] Inventors: Satoru Kuse; Masao Ishikawa; Shigeharu Koboshi; Yoshiharu Mochizuki; Kenji Kumashiro, all of Hino, Japan

[73] Assignee: Konica Corporation, Tokyo, Japan

[21] Appl. No.: 512,059

[22] Filed: Apr. 19, 1990

Related U.S. Application Data

[63] Continuation of Ser. No. 310,369, Feb. 13, 1989, abandoned.

[30] Foreign Application Priority Data

Feb. 15, 1988 [JP] Japan ..... 63-32501
Mar. 11, 1988 [JP] Japan ..... 63-59000

[51] Int. Cl.[5] ..... G03C 5/44

[52] U.S. Cl. ..... 430/393; 430/430; 430/461; 430/496

[58] Field of Search ..... 430/393, 430, 461, 496, 430/503

[56] References Cited

U.S. PATENT DOCUMENTS 4,578,345 3/1986 Ohno et al. ..... 430/393
4,804,618 2/1989 Ueda et al. ..... 430/393
4,818,667 4/1989 Hamada et al. ..... 430/502
4,833,069 5/1989 Hamada et al. ..... 430/496

*Primary Examiner*—Richard L. Schilling
*Assistant Examiner*—Janet C. Baxter
*Attorney, Agent, or Firm*—Jordan B. Bierman

[57] ABSTRACT

A method for forming photographic color images is disecond closed, in which a silver halide color photographic light-sensitive material is rapidly processed with low replenishment of processing solutions. The images improved in lowered yellow stain can be obtained. The processing comprises steps of color developing, bleaching immediately after the developing step, and treating with a bath having a fixing capability following the bleaching step. The steps of bleaching and treating with a solution having a fixing capability are carried out for a time of not more than 3 minutes 45 seconds at a temperature of from 20° to 45° C. The light-sensitive material comprises silver halide emulsion layers each containing silver bromide and/or silver boromoiodide grains and satsifies at least one of the following requirements (1) and (2); (1) a blue light-sensitive emulsion layer included in the silver halide emulsion layers has a silver density d of not less than $4.0\times10^{-1}$ g/cm$^3$. (2) a green light-sensitive emulsion layer included in the silver halide emulsion layers has a silver density d of not less than $6.0\times10^{-1}$ g/cm$^3$.

10 Claims, No Drawings

METHOD OF FORMING COLOR PHOTOGRAPHIC IMAGES

This application is a Continuation of application Ser. No. 310,369, filed Feb. 13, 1989, now abandoned.

FIELD OF THE INVENTION

This invention relates to a method of forming color photographic images and on a silver halide photographic light-sensitive material more particularly, to a method of forming color photographic images, in which a rapid processing can be made and a bleach-fogging can also be improved.

BACKGROUND OF THE INVENTION

Basically, a silver halide color light-sensitive material is processed in the two treatments, namely, a color developing treatment and a desilvering treatment. The desilvering treatment is ordinarily comprised of a bleaching step and a fixing or fixing-bleaching step in which a fixing capability can be displayed. Besides the above, a rinsing step, a stabilizing step and so forth may also be added as additional processing steps.

As for oxidizing agent for bleaching image-forming silver, organic acid metal complex salts such as aminopolycarboxylic acid metal salts and so forth have been used, because they have few polution problems and are able to satisfy the demands for reclamation of waste solutions. However, the processing solutions containing the organic acid metal complex salts have the following defects, because the oxidizing function thereof is relatingly lower. Namely, one of the defects is that the bleaching rate, i.e., the oxidizing rate, of image-forming silver is low and another defect is that it takes a long time to carry out a bleaching step particularly with a high-speed silver halide color photographic light-sensitive material mainly comprising a silver bromide or silver iodobromide emulsion or with a color paper, color negative film or color reversal film for directly photographing, each highly containing silver.

In the case that a lot of silver halide photographic light-sensitive materials are successively processed with an automatic processor or the like, it is required to provide a means for keeping the components of a processing solution constant within a certain range of the concentration so as to prevent a bleaching solution from the malfunction caused by the variations of the component concentration. There have, accordingly, been the proposals for replenishing a concentrated replenisher in a small amount, that is so-called a highly concentrated and low replenishing system, and for adding a reclaimant into an over-flow solution so that the over-flow solution may serve again as a replenisher.

Concerning bleaching solutions, in particular, a method for reclaiming a bleaching solution has been put to practical use, in which an organic acid ferrous complex salt produced by bleaching image-forming silver is so reconstituted by oxidizing it as to be an organic acid ferric complex salt and a reclaimant is so added thereto as to compensate a shortage of components, so that the resulted solution may serve as a replenisher.

In recent years, however, at so-called compact type photofinishing laboratories which are on the rise and also known as mini-labs, there are serious needs for simplifying processing steps and saving the floor space for installing processors. Therefore, it is not desirable to provide a reclaiming system which particularly requires troublesome labor and control as well as an extra floor space for reclamation.

From the above-mentioned points, the foregoing highly concentrated and low replenishing system could be preferred. In this system, however, if an amount of a bleaching solution to be replenished should extremely be reduced, a problem may be raised by increasing the concentration of the components of a color developer carried into a bleaching solution, so that a bleaching reaction has to be inhibited and, more seriously, another problem may be raised by the increase in yellow stains. The deterioration of image preservability will be emphasized, in the recent low replenishing system for color developer.

SUMMARY OF THE INVENTION

An object of the invention to provide a method of forming color photographic images on a silver halide color photographic material, in which a rapid and low replenishment can be performed and, at the same time, yellow stain increase can also be inhibited.

The foregoing object of the invention can be achieved in a method for forming color photographic images comprising steps of imagewise exposing to light a silver halide color photographic light-sensitive material developing the light-sensitive material with a color developer, bleaching, immediately after the developing step, the light-sensitive material with a bleaching solution, and treating, following the bleaching steps, the light-sensitive material with a bath having a fixing capability, wherein the steps of bleaching and treating with a bath having a fixing ability are carried out for a time of not more than 3 minutes 45 seconds in total at a temperature within the range of from 20° C. to 45° C.;

the light-sensitive material comprises silver halide emulsion layers each containing negative type silver halide grains substantially consisting of silver bromide and/or silver iodobromide; and satisfies at least one of the following requirements (1) and (2);

(1) a blue light-sensitive silver halide emulsion layer included in the silver halide emulsion layers has a silver density d of not less than $4.0\times10^{-1}$ g/cm$^3$, and (2) a green light-sensitive silver halide emulsion layer included in the silver halide emulsion layer has a silver density d of not less than $6.0\times10^{-1}$ g/cm$^3$, wherein silver density d is defined by the following formula;

$$d=N/V$$

in the above formula, N is a silver content by gram, as the unit, of a silver halide emulsion layer; and V is a volume, cm$^3$ as the unit, of the silver halide emulsion layer having the N.

In the invention, the blue light-sensitive silver halide emulsion layer and the green light-sensitive silver halide emulsion layer include those comprising two or more layers, respectively. The above-mentioned d, N, V and thereof are calculated in terms of a total value of the two or more layers, respectively.

A value of V may be obtained by multiplying a coated area and a dried thickness together.

A dried thickness may be measured by megascopically photographing the section of a dried sample with a scanning type electron microscope.

With respect to the blue light-sensitive and green light-sensitive layers, the dried thicknesses thereof should preferably be not thicker than 4.0 μm and 6.0 μm, respectively. From the viewpoints of coatability and color density, the thicknesses thereof should be, referably, within the range of from 0.8 to 4.0 μm and from 1.2 to 6.0 μm and, more preferably, within the range of from 1.0 to 3.8 μm and from 1.5 to 5.7 μm, respectively.

In the invention, a silver content that determines the above-mentioned silver density is measured in an atomic absorption spectro-photometry.

The silver density is as mentioned above. With respect to blue light-sensitive emulsion layers, the silver density thereof should be, preferably, not more than 2.0 $g/cm^3$ and, more preferably, not more than 1.2 $g/cm^3$ from the viewpoint of graininess and foginess. With respect to green light-sensitive emulsion layers, it should be, preferably, not more than 3.25 $g/cm^3$ and, more preferably, not more than 2.0 $g/cm^3$.

With respect to the silver halide composition of the silver halide grains relating to the invention, the phrase mentioning, '—substantially consisting of silver bromide and/or silver iodobromide—', means that any other silver halides such as silver chloride than silver bromide or silver iodobromide may be contained, provided that the effects of the invention shall not be hindered from displaying. To be more concrete, when silver chloride is contained, the proportion thereof to a total content of silver halide should preferably be not more than 30 mol%.

In each of the silver halide emulsion layers, an average silver iodide content of the silver halide grains should preferably be not more than 30 mol%, more preferably, within the range of from 1 to 20 mol% and, most preferably, within the range of from 3 to 15 mol%. The silver halide grains described in Japanese Patent Publication Open to Public Inspection (hereinafter referred to as Japanese Patent O.P.I. Publication) Nos. 61-245151/1986 and 60-143331/1985, and so forth should preferably be used for.

As for such silver halide grains as mentioned above, it is allowed to use either grains capable of forming a latent image mainly on the surface thereof or grains capable of forming it mainly inside thereof. The sizes of such silver halide grains are within the range of from 0.05 to 30 μm and, preferably, from 0.1 to 20 μm.

As for such silver halide emulsions as mentioned above, it is allowed to use any of those such as a polydisperse type emulsion having a broard grain size distribution, a monodisperse type emulsion having a narrow grain size distribution and so forth. When embodying the invention, it is preferable to use the monodisperse type emulsions independently or in combination after sensitizing them.

Such monodisperse type emulsions include those containing silver halides each having a grain size not exceeding plus or minus 20% of an average grain size $\bar{r}$, provided that the silver halide content by weight thereof should be, preferably, not less than 60% of the total silver halide grains by weight, more preferably, not less than 70% and, further preferably, not less than 80%.

The term, an average grain size $\bar{r}$, is herein defined as a grain size ri obtained when maximizing a product, $n_i x r_i^3$, that is a multiplication of a frequency ni of grains having a grain size ri and $r_i^3$ together, provided that the effective number shall be those of three figures and, in number of the lowest figure, fractions of 0.5 or over are to be counted as a unit and cut away the rest.

The term, 'grain size ri', means herein a diameter of a silver halide grain when the grain is spherical-shaped and a diameter of a circular image having the same area as the projective image of a gain when the grain is in any other shapes than the spherical-shaped.

Such grain sizes may be measured in such a manner that a grain is magnified ten thousand times to fifty thousand times larger and photographed with an electron microscope and the diameter of the grain on a print or the area of the projected grain is then actually measured, provided that the number of grains to be measured are not less than 1,000, without discrimination.

When a grain size distribution is defined by the following formula, $$\frac{\text{Standard deviation}}{\text{Average grain size}} \times 100 = \text{Variation coefficient (\%)},$$

a particularly preferable high-grade monodisperse type emulsion has a variation coefficient of not higher than 20% and, more preferably, not higher than 15%.

Herein, an average grain size and a standard deviation are to be obtained in accordance with the above-mentioned definition ri.

The foregoing monodisperse type emulsions may be prepared in such a manner that a water-soluble silver salt solution and a water-soluble halide solution are added into a gelatin solution containing seed grains by a double-jet precipitation method while controlling pAg and pH values.

For determining a rate of addition thereof, the descriptions in Japanese Patent O.P.I. Publication Nos. 54-48521/1979 and 58-49938/1983 may be referred.

A further high grade monodisperse type emulsion may be prepared in the method disclosed in Japanese Patent O.P.I. Publication No. 60-122935/1985 for growing silver halide grains of an emulsion in the presence of tetrazaindene.

Such silver halide emulsions may be chemically sensitized in an ordinary method.

Silver halide emulsions of the invention may be optically sensitized to a desired spectral wavelength region by making use of dyes well known as a sensitizing dye in the photographic industry. Such sensitizing dyes may be used independently or in combination.

Such silver halide emulsions may also be added with an antifoggant, a stabilizer and so forth. Gelatin may advantageously be used as a binder for such emulsions.

Emulsion layers and other hydrophilic colloidal layers may be hardened and may also contain a plasticizer and a water-insoluble or hardly soluble synthetic polymer dispersion, i.e., a latex.

It is allowed to use couplers in the emulsion layers of color photographic light-sensitive materials.

It is also allowed to use a colored coupler capable of displaying a color correction effect, a competing coupler and a compound capable of releasing various fragments therefrom upon coupling to the oxidized product of a developing agent, such photographically effective fragments include, for example, a development accelerator, a bleach accelerator, a developing agent, a silver halide solvent, a color controlling agent, a hardener, a foggant, an antifoggant, a chemical sensitizer, a spectral sensitizer, a desensitizer and so forth.

It is also allowed to provide to light-sensitive materials each with auxiliary layers such as a filter layer, an antihalation layer, an anti-irradiation layer and so forth. Such auxiliary layers and/or the emulsion layers are further allowed to contain a dye which is flown out of the light-sensitive material or bleached, in the course of a development process.

Such light-sensitive materials may be added with a formalin scavenger, an optical brightening agent, a matting agent, a lubricant, an image stabilizer, a surface active agent, an anticolor-fogging agent, a development accelerator, a development inhibitor and a bleach accelerator.

As for the supports, a sheet of paper laminated thereon with polyethylene or the like, a polyethyleneterephthalate film, a sheet of baryta paper, a cellulose triacetate film and so forth may be used.

A light-sensitive material satisfying the requirements of the invention is further applied with a process in which the processing time starting from a color development is shortened.

Some preferable processing steps of the above-mentioned processing method will be detailed below.

1. Color developing - Bleaching - Fixing - Washing,
2. Color developing - Bleaching - Fixing - Washing - Stabilizing
3. Color developing - Bleaching - Fixing - Stabilizing,
4. Color developing - Bleaching - Fixing - 1st stabilizing - 2nd stabilizing.
5. Color developing - Bleaching - Bleach-fixing - Washing,
6. Color developing - Bleaching - Bleach-fixing - Washing - Stabilizing,
7. Color developing - Bleaching - Bleach-fixing - Stabilizing, or
8. Color developing - Bleaching - Bleach-fixing - 1st stabilizing - 2nd stabilizing.

Among these processing steps, the steps 3, 4, 7 and 8 are preferable and, inter alia, the steps 3 and 4 are particularly preferable.

As for one of the preferable embodiments in which a different processing method is used, there is a method in which a part or the whole of the over-flow of a color developer is carried into the bleaching bath that is the successive step. According to this method, a sludge production in the bleaching bath may be improved by carrying a certain amount of the color developer into the bleaching bath.

In addition to the above-mentioned methods, when a part or the whole of the over-flow of a stabilizer which is used in a succeeding step is carried into either a bleach-fixer or a fixer, an excellent effect can be displayed to improve a silver recovery efficiency.

The period of time for processing the above-mentioned silver halide color photographic light-sensitive material with the color developer should preferably be not longer than 180 seconds, 150 seconds, and within the range of from 20 to 150 seconds, from 30 to 120 seconds and from 40 to 100 seconds, that is, the latter the better.

When the above-mentioned silver halide color photographic light-sensitive material is processed within such a short time as mentioned above, the graininess of dye images obtained can also be improved.

Such a color developer as mentioned above contains an aromatic primary amine type color developing agent in an amount of, preferably, not less than $1.5\times10^{-2}$ *mol* per mol of the developer.

More preferably, the above-mentioned color developing agent are to be contained in an amount of not less than $2.0\times10^{-2}$ mol and within the range of from $2.5\times10^{-2}$ to $2\times10^{-1}$ mol and from $3\times10^{-2}$ to $1\times10^{-1}$ mol, and the latter the better.

When the above-mentioned photographic light-sensitive material is developed in an activated condition by making such a color developing agent highly concentrated, images excellent in sharpness and improved in graininess can be obtained within such a short processing time as mentioned above. In particular, it is remarkable in magenta dye images.

Now, the description will be made about the color developing agents preferably applicable to color developers.

The above-mentioned aromatic primary amine type color developing agents preferably applicable to color developers include well-known ones being widely used in various color photographic processes. Those developing agents include aminophenol type and p-phenylenediamine type derivatives. These compounds are generally used in the form of a salt such as a hydrochloride or sulfate, because they are more stable than they are in a free state.

Aminophenol type developing agents include, for example, o-aminophenol, p-aminophenol, 5-amino-2-hydroxytoluene, 2-amino-3-hydroxytoluene, 2-hydroxy-3-amino-1,4-dimethylbenzene, and so forth.

There are some aromatic primary amine type color developing agents which are particularly useful for improving the crystal deposition produced on the inner wall of the color developing tank of an automatic processor. They are aromatic primary amine type color developing agents each having an amino group containing at least one water-soluble group.

Those particularly useful aromatic primary amine type color developing agents include, more preferably, the compounds represented by the following Formula E.

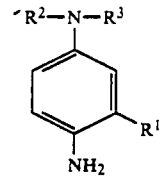

Formula E wherein $R^1$ represents a hydrogen atom, a halogen atom or an alkyl group, and the alkyl groups each represent a straight-chained or branched alkyl group having 1 to 5 carbon atoms and which includes ones having a substituent; and $R^2$ and $R^3$ each represent a hydrogen atom, an alkyl group or an aryl group, each of which includes ones having a substituent, and at least one of $R^2$ and $R^3$ is an alkyl group substituted with such a water-soluble group as a group of hydroxyl, carboxy group, sulfonic group, amino, sulfonamido or the like, or $-(CH_2)_q-O]_p-R^4$ group. These alkyl groups each include ones having a substituent.

In the above $-(CH_2)_q-O]_p-R^4$, $R^4$ represents a hydrogen atom or a alkyl group and the alkyl groups each represent a straight-chained or branched alkyl group having 1 to 5 carbon atoms; and p and q each are an integer of 1 to 5.

Next, the compounds each represented by the above-given Formula E will be exemplified below. However, the compounds shall not be limited thereto.

Exemplified compounds
(E-1)
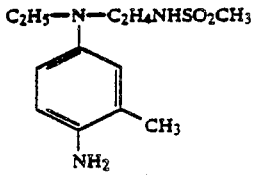
(E-2)
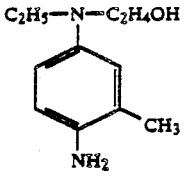
(E-3)
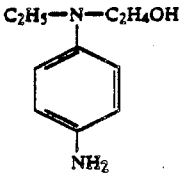
(E-4)
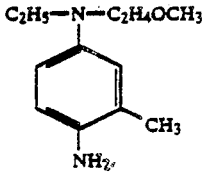
(E-5)
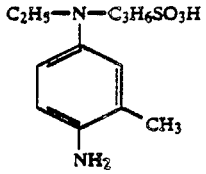
(E-6)
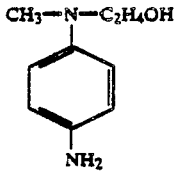
(E-7)
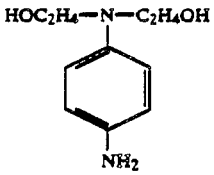
(E-8)
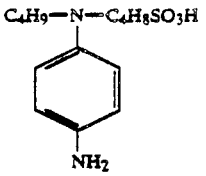
-continued
Exemplified compounds
(E-9)
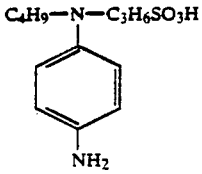
(E-10)
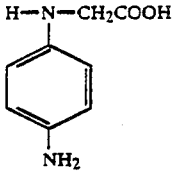
(E-11)
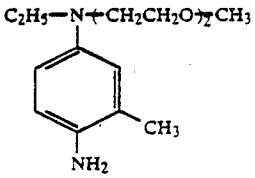
(E-12)
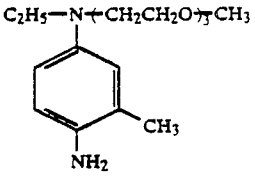
(E-13)
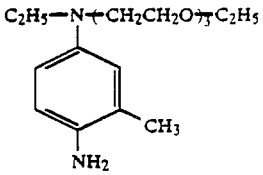
(E-14)
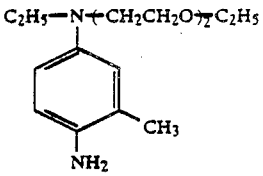
(E-15)
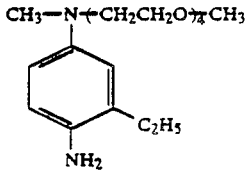
(E-16)
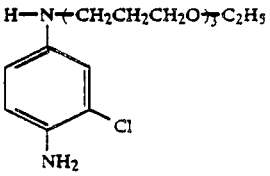
The above-mentioned p-phenylenediamine derivatives represented by the foregoing Formula E may be used in the forms of the salts of organic or inorganic acids such as a hydrochloride, sulfate, phosphate, p-toiuenesulfonate, sulfite, oxalate, benzenedisulfonate or the like.

Among the p-phenylenediamine derivatives represented by the foregoing Formula E, those in which $R^2$ and/or $R^3$ represent $-(CH_2)_q-O)_p-R^4$ in which p, q and $R^4$ each are synonymous with the afore-given ones, in particular, can excellently display the effects of the invention.

The compounds which may preferably be used in a color developer include, for example, a sulfite, hydroxylamine and a development inhibitor. Such sulfites include, for example, sodium sulfite, sodium hydrogensulfite, potassium sulfite, potassium hydrogensulfite and so forth and they may be used within the range of, preferably, from 0.1 to 40 g/liter and, more preferably, from 0.5 to 10 g/liter. The above-mentioned hydroxylamine is used in an amount within the range of, preferably, from 0.1 to 40 g/liter and, more preferably, from 0.5 to 10 g/liter, as a salt of hydrochloride, sulfate or the like. The development inhibitors which may preferably be used in the foregoing color developers include, for example, such a halide as sodium bromide, potassium bromide, sodium iodide, potassium iodide and so forth and, besides the above, an organic development inhibitor. These inhibitors are added in an amount within the range of, preferably, from 0.005 to 20 g/liter and, more preferably, from 0.01 to 5 g/liter.

Such color developers are further allowed to contain a variety of any components which are usually added thereto, including, for example, such an alkalizer as sodium hydroxide, sodium carbonate and so forth, an alkali thiocyanate, an alkali halide, benzyl alcohol, a water softener, a liquid thickener, a development accelerator and so forth.

Besides the above-given components, the other additives which may be added to the color developers include, for example, an antistaining agent, a sludge-proofing agent, a preservatives, an interlayer effect accelerator, a chelating agent and so forth.

Such color developers should be used at a pH value of, preferably, not lower than pH 9 and, more preferably, within the range of from pH 9 to 13.

Such color developers should be used at a temperature within the range of, preferably, from 20° C. to 45° C. and, more preferably, from 30° C. to 45° C. from the viewpoints of the stability and rapid processability of the color developers.

The bleaching agents preferably used in a bleaching solution include, for example, the ferric complex salts of the compounds represented by the following Formula A.

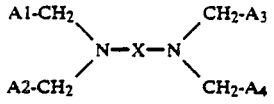

Formula A wherein $A_1$ through $A_4$ each represent $-CH_2OH$, $-COOM$ or $-PO_3M_1M_2$ and may be the same with or the different from each other, and M, $M_1$ and $M_2$ each represent a hydrogen atom, a sodium atom, a potassium atom or an ammonium group, respectively; and X represents a substituted or unsubstituted alkylene group having 3 to 5 carbon atoms such as a propylene group and a pentamethylene group.

The substituents include, for example, a hydroxylic acid group.

Now, the compounds represented by the foregoing Formula A will be exemplified below.

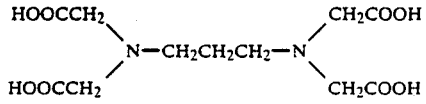

(A-1)

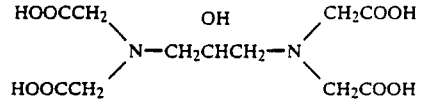

(A-2)

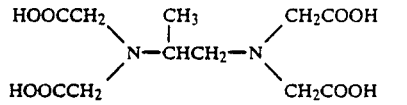

(A-3)

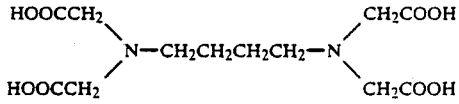

(A-4)

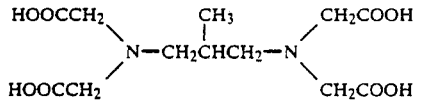

(A-5)

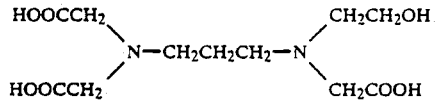

(A-6)

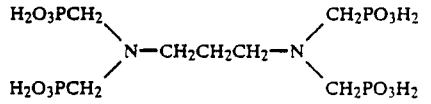

(A-7)

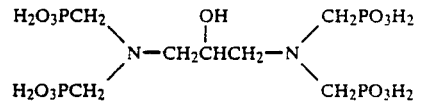

(A-8)

The compounds represented by Formula A also include the sodium salts, potassium salts and ammonium salts of the above-given compounds A-1 through A-8, besides the compounds A-1 through A-8. The ammonium salts of the ferric complex salts of the above-given compounds may preferably be used as a bleaching agent.

Among the compounds exemplified. A-1 through A-4 and A-7 may preferably be used and, in particular. A-1 may more preferably be used.

The ferric complex salts of the compounds represented by the foregoing Formula A are used in an amount within the range of, preferably, from 0.002 mol to 0.4 mol per liter of a bleaching solution used, more preferably, from 0.1 mol to 0.3 mol and, further preferably, from 0.05 mol to 0.25 mol.

It would be enough to add at least one kind of the ferric complex salts of the compounds represented by Formula A into a bleaching solution. It is, however, allowed to use the ferric complex salts in combination with other aminopolycarboxylic acid ferric complex salts such as an ethylenediaminetetraacetic acid ferric complex salt, a diethylenetriaminepentaacetic acid ferric complex salt, a 1,2-cyclohexanediaminetetraacetic acid ferric complex salt, a glycoletherdiaminetetraacetic acid ferric complex salt, and so forth. It is particularly preferable to use in combination with an ethylenediaminetetraacetic acid ferric complex salt from the viewpoints that it is economical and a fog production may be diminished in bleaching step.

Such bleaching solution is replenished in an amount within the range of, preferably, from 20 ml to 500 ml, from 30 ml to 350 ml, from 40 ml to 300 ml and from 50 ml to 250 ml each per sq. meter of a silver halide color photographic light-sensitive material used, and the latter, the better.

The bleaching agents preferably applicable to a bleach-fixers include, for example, the ferric complex salts of aminocarboxylic acid or aminophosphonic acid. Such aminocarboxylic acid and aminophosphonic acid mean an amino compound having at least two carboxyl groups and an amino compound having at least two phosphonic acid groups, and they include, preferably, the compounds represented by the following Formulas XII and XIII.

Formula XII

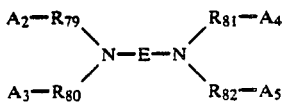

Formula XIII

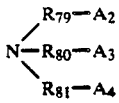

wherein E represents a substituted or unsubstituted groups of alkylene, cycloalkylene, phenylene, —$R_{83}OR_{83}OR_{83}$—or—$R_{83}ZR_{83}$—group: Z represents

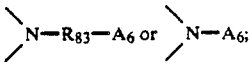

$R_{79}$ through $R_{83}$ each represent a substituted or unsubstituted alkylene group; $A_2$ through $A_6$ each represent a hydrogen atom, —OH, —COOM or —$PO_3M_3$; and M represents a hydrogen atom, an alkali metal atom or an ammonium group.

Next, the following compounds will typically be given as some concrete examples of the compounds represented by the foregoing Formulas XII and XIII.

Exemplified compounds

XII-1 Ethylenediaminetetraacetic acid,
XII-2 Diethylenetriaminepentaacetic acid,
XII-3 Ethylenediamine-N-(β-hydroxyethyl)-N,N',N'-triacetic acid,
XII-4 1,3-propylenediaminetetraacetic acid,
XII-5 Triethylenetetraminehexaacetic acid,
XII-6 Cyclohexanediaminetetraacetic acid,
XII-7 1,2-diaminopropanetetraacetic acid,
XII-8 1,3-diaminopropane-2-ol-tetraacetic acid,
XII-9 Ethyletherdiaminetetraacetic acid,
XII-10 Glycoletherdiaminetetraacetic acid,
XII-11 Ethylenediaminetetrapropionic acid,
XII-12 Phenylenediaminetetraacetic acid,
XII-13 Disodium ethylenediaminetetraacetate,
XII-14 Tetra(Tri)methyl ammonium ethylenediaminetetraacetate,
XII-15 Tetrasodium ethylenediaminetetraacetate,
XII-16 Pentasodium diethylenetriaminepentaacetate,
XII-17 Sodium ethylenediamine-N-(β-hydroxyethyl)-N,N',N'-triacetate,
XII-18 Sodium propylenediaminetetraacetate,
XII-19 Ethylenediaminetetramethylenephosphonic acid,
XII-20 Sodium cyclohexanediaminetetraacetate,
XII-21 Diethylenetriaminepentamethylenephosphonic acid,
XII-22 Cyclohexanediaminetetramethylenephosphonic acid,
XIII-1 Nitrilotriacetic acid,
XIII-2 Methyliminodiacetic acid,
XIII-3 Hydroxyethyliminodiacetic acid,
XIII-4 Nitrilotripropionic acid,
XIII-5 Nitrilotrimethylenephosphonic acid,
XIII-6 Iminodimethylenephosphonic acid,
XIII-7 Hydroxyethyliminodimethylenephosphonic acid, and
XIII-8 Trisodium nitrilotriacetate.

Among the aminocarboxylic acid and aminophosphonic acid, the particularly preferable compounds from the viewpoint of the effects of the objects of the invention include those of XII-1, XII-2, XII-4, XII-6, XII-7, XII-10, XII-19, XIII-1 and XIII-5, among which XII-4 is particularly preferable.

The foregoing ferric complex salts of organic acids are used in the form of free salts such as a hydrogen salt; alkali metal salts such as a sodium salt, a potassium salt, a lithium salt and so forth; ammonium salts; or water-soluble amine salts such as a triethanolamine salt and so forth. Among them, potassium salts, sodium salts and ammonium salts are preferably used.

It would be enough to use at least one kind of these ferric complex salts. It is, however, allowed to use them in combination. They may be used in any amount selectively in accordance with the requirements such as those for the silver contents of a light-sensitive material to be processed, the silver halide compositions thereof and so forth.

For instance, they are used in an amount of not less than 0.1 mol per liter of a bleach-fixer used and, preferably, in an amount within the range of from 0.05 to 1.0 mol.

About replenishers, it is preferable to use each of them upon concentrating them up to a level where the solubility thereof is to be at a maximum, because the replenisher is to be concentrated and less replenished.

Where a bleaching solution and bleach-fixer contain imidazole and the derivative thereof or at least one kind of the compounds represented by the following Formulas I through IX, there also displays an effect on the improvement of the precipitates which are produced due to the presence of the silver contained in the bleaching solution. Therefore, such compound should preferably be added.

Formula I

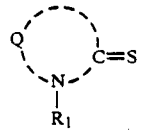

wherein Q represents a group consisting of atoms which are necessary to complete a nitrogen-containing heterocyclic ring including a ring condensed with a 5- or 6-membered unsaturated ring, and $R_1$ represents a hydrogen atom, an alkyl group having 1 to 6 carbon atoms, a cycloalkyl group, an aryl group, a heterocyclic group including those each condensed with a 5- or 6-membered unsaturated ring, or an amino group.

Formula II

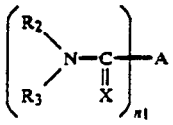

wherein $R_2$ and $R_3$ each represent a hydrogen atom, an alkyl group having 1 to 6 carbon atoms, a hydroxy group, a carboxy group, an amino group, an acyl group having 1 to 3 carbon atoms, an aryl group or an alkenyl group; A represents groups of

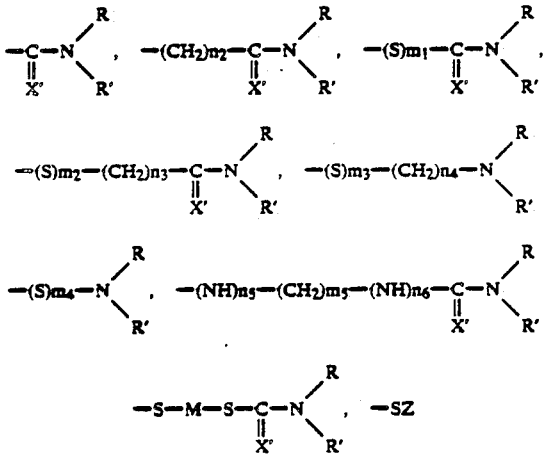

or an $n_1$ valent heterocyclic group including those condensed with a 5- or 6-membered unsaturated ring: X represents =S, =O or =NR", in which R and R' each are synonymous with $R_2$ and $R_3$, X' is synonymous with X, Z represents a hydrogen atom, an alkali metal atom, an ammonium group, an amino group, a nitrogen-containing heterocyclic residual group, an alkyl group, or

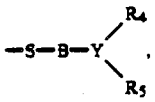

M represents a divalent metal atom, R" represents a hydrogen atom, an alkyl group having 1 to 6 carbon atoms, a cycloalkyl group, an aryl group, a heterocyclic group including those each condensed with a 5- or 6-membered unsaturated ring, or an amino group. $n_1$ to $n_6$ and $m_1$ to $m_5$ each are an integer of 1 to 6, B represents an alkylene group having 1 to 6 carbon atoms, Y represents

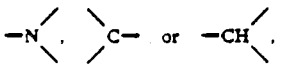

$R_4$ and $R_5$ each are synonymous with $R_2$ and $R_3$, provided that $R_4$ and $R_5$ each may represent —B and/or —SZ and that $R_2$ and $R_3$, R and R' and, $R_4$ and $R_5$ each may also bond together so as to complete a ring.

The compounds represented by the above-given formula include an enolized substance and the salts thereof.

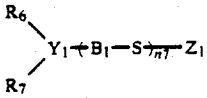

wherein $R_6$ and $R_7$ each represent a hydrogen atom, an alkyl group having 1 to 6 carbon atoms, a hydroxyl group, a carboxyl group, an amino group, an acyl group having 1 to 3 carbon atoms, an aryl group, an alkenyl group or $—B_1—S—Z_1$, provided that $R_6$ and $R_7$ are allowed to bond together to complete a ring; $Y_1$ represents

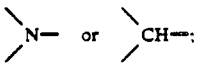

$B_1$ represents an alkylene group having 1 to 6 carbon atoms; $Z_1$ represents a hydrogen atom, an alkali metal atom, an ammonium group, an amino group, a nitrogen-containing heterocyclic group or

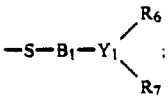

$n_7$ is an integer of 1 to 6.

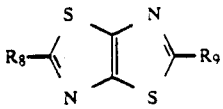

wherein $R_8$ and $R_9$ each represent

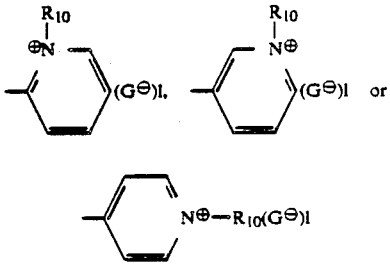

$R_{10}$ represents an alkyl group or $—(CH_2)_{n_8}SO_3^{\ominus}$, provided that, when $R_{10}$ is $—(CH_2)_{n_8}SO_3^{\ominus}$, l is zero and, when $R_{10}$ is an alkyl group, l is 1; $G^{\ominus}$ represents an anion; and $n_8$ is an integer of 1 to 6.

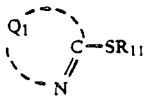

wherein Q represents a group consisting of atoms necessary to complete a nitrogen-containing heterocyclic ring including those each condensed with a 5- or 6-membered unsaturated raing; and $R_{11}$ represents a hydrogen atom, an alkali metal atom,

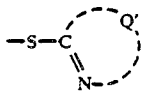

in which Q' is synonymous with $Q_1$, or an alkyl group.

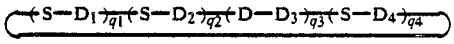

wherein $D_1$, $D_2$, $D_3$ and $D_4$ each represent a single linkage, an alkylene group having 1 to 8 carbon atoms or a vinylene group; $q_1$, $q_2$, $q_3$ and $q_4$ each represent an integer of 0, 1 or 2; and a ring formed together with a sulfur atom is further allowed to be condensed with a saturated or unsaturated 5- or 6-membered ring.

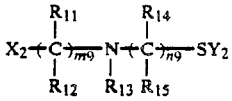

wherein $X_2$ represents groups of —COOM', —OH, —$SO_3M'$, —$CONH_2$, —$SO_2NH_2$, —$NH_2$, —SH, —CN, —$CO_2R_{16}$, —$SO_2R_{16}$, —$OR_{16}$, —$NR_{16}R_{17}$, —$SR_{16}$, —$SO_3R_{16}$, —$NHCOR_{16}$, —$NHSO_2R_{16}$, —$COR_{16}$ or —$SO_2R_{16}$; $Y_2$ represents

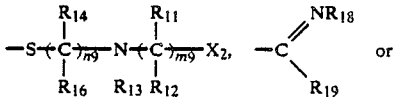

hydrogen atom; $m_9$ and $n_9$ each are an integer of from 1 to 10; $R_{11}$, $R_{12}$, $R_{13}$, $R_{14}$, $R_{15}$, $R_{17}$ and $R_{18}$ each represent a hydrogen atom, a lower alkyl group, an acyl group or

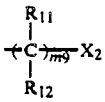

$R_{16}$ represents a lower alkyl group: $R_{19}$ represents —$NR_{20}R_{21}$, —$OR_{22}$ or —$SR_{22}$; $R_{20}$ and $R_{21}$ each represent a hydrogen atom or a lower alkyl group; and $R_{22}$ represents a group consisting of atoms necessary to complete a ring upon bonding to $R_{18}$; $R_{20}$ or $R_{11}$ is allowed to complete a ring upon bonding to $R_{18}$; and M' represents a hydrogen atom or a cation.

Formula VIII

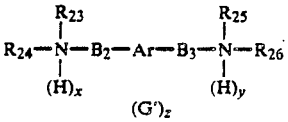

wherein Ar a divalent aryl group or a divalent organic group completed by combining an aryl group with an oxygen atom and/or an alkylene group; $B_2$ and $B_3$ each represent a lower alkylene group; $R_{23}$, $R_{24}$, $R_{25}$ and $R_{26}$ each represent a hydroxy-substituted lower alkyl group; x and y each are an integer of 0 or 1; G' represents an anion; and z is an integer of 0, 1 or 2.

Formula IX

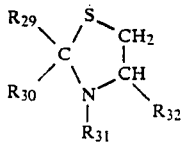

wherein $R_{29}$ and $R_{30}$ each represent a hydrogen atom, an alkyl group, an aryl group or a heterocyclic group: $R_{31}$ represents a hydrogen atom or an alkyl group and $R_{32}$ represents a hydrogen atom or a carboxyl group.

The compounds each represented by Formulas I through IX, which are preferably applicable to the invention, are generally used as a bleaching accelerator.

Typical examples of the bleaching accelerators represented by the foregoing Formulas I through IX may be given as follows. It is, however, to be understood that the invention shall not be limited thereto.

Exemplified compounds (I-1)

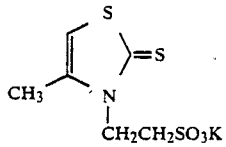

(I-2)

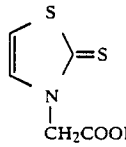

(I-3)

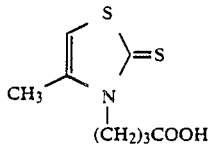

(I-4)

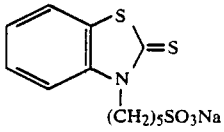

(I-5)

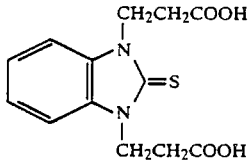

(I-6)

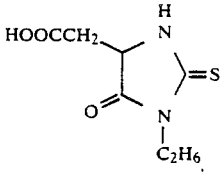

-continued
(I-7)
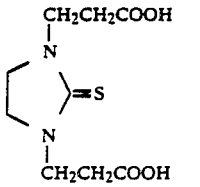
(I-8)
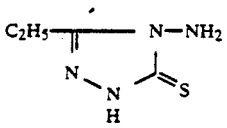
(I-9)
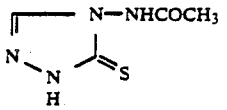
(I-10)
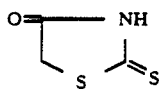
(II-1)
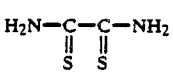
(II-2)
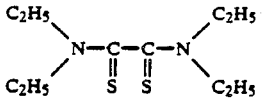
(II-3)
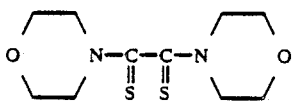
(II-4)
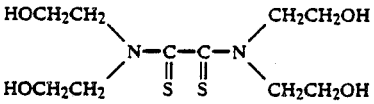
(II-5)
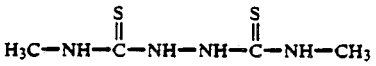
(II-6) $H_2N-CSNHNHCS-NH_2$
(II-7) $H_2N-CSNH(CH_2)_2NHCS-NH_2$
(II-8)
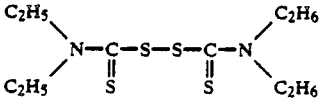
(II-9)
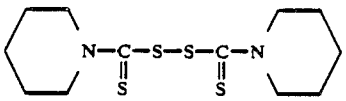
(II-10)
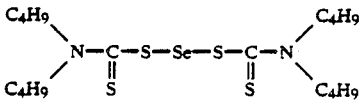
(II-11)
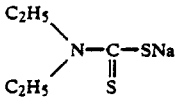
-continued
(II-12)
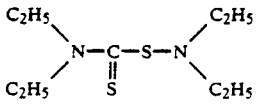
(II-13)
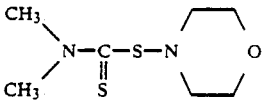
(II-14)
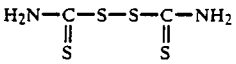
(II-15)
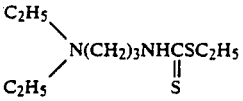
(II-16)
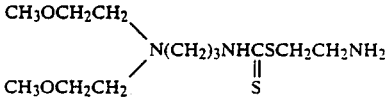
(II-17)
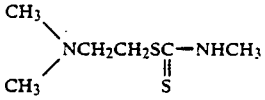
(II-18)
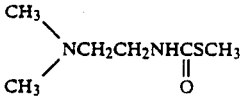
(II-19)
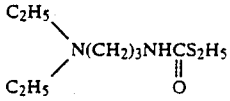
(II-20)
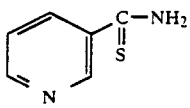
(II-21)
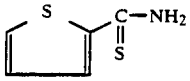
(II-22)
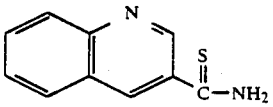
(II-23)
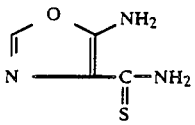
(II-24)
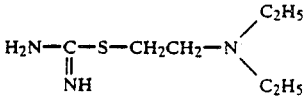
(II-25)
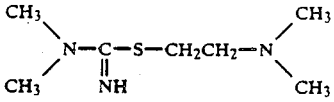

-continued
(II-26)
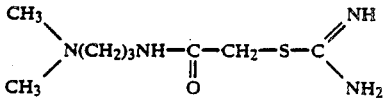
(II-27)
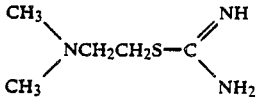
(III-1) $H_2N—CH_2CH_2—SH$
(III-2)
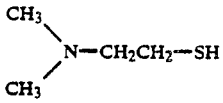
(III-3)
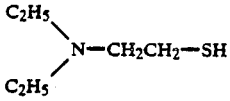
(III-4) $HOOC—CH_2CH_2—SH$
(III-5)
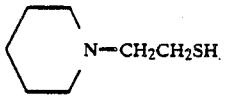
(III-6)
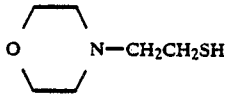
(III-7)
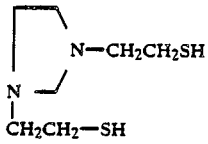
(III-8)
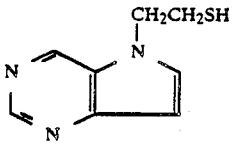
(III-9)
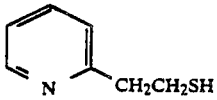
(III-10)
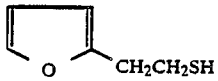
(III-11)
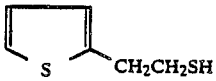
(III-12)
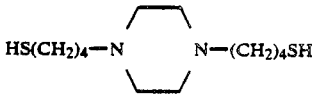
(III-13)
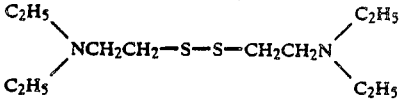
-continued
(III-14)
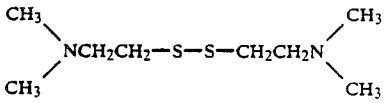
(III-15)
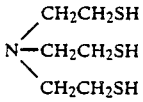
(IV-1)
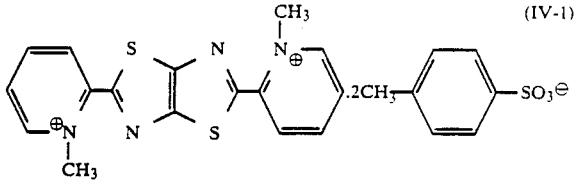
(IV-2)
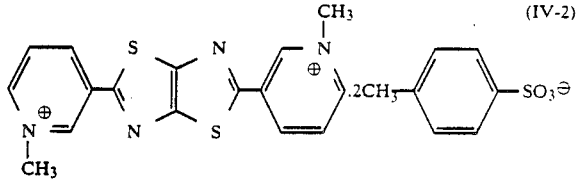
(IV-3)
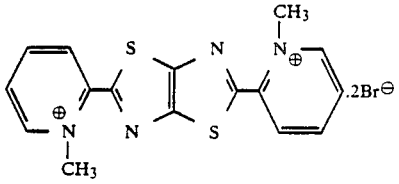
(V-1)
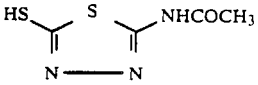
(V-2)
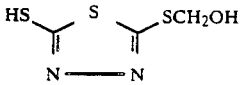
(V-3)
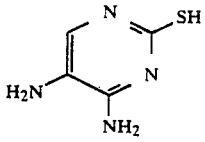
(V-4)
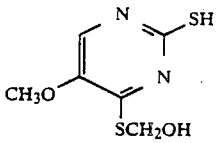
(V-5)
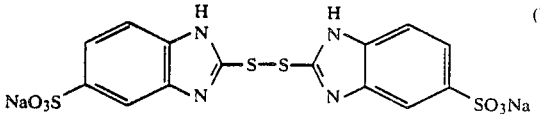
(V-6)
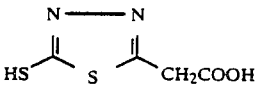

-continued
(V-7)
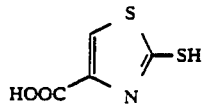
(V-8)
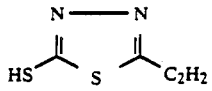
(V-9)
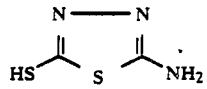
(V-10)
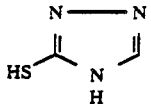
(V-11)
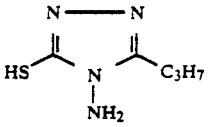
(V-12)
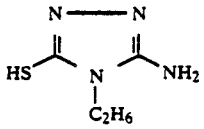
(V-13)
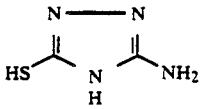
(V-14)
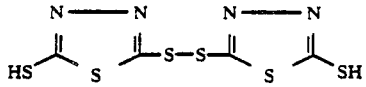
(V-15)
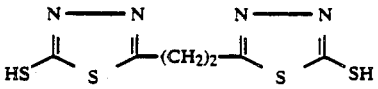
(V-16)
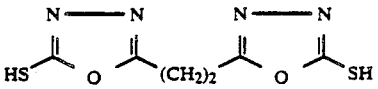
(V-17)
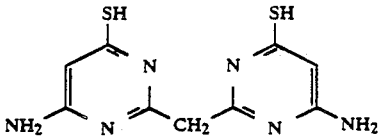
(V-18)
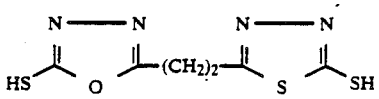
(V-19)
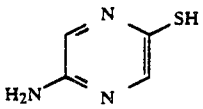
-continued
(V-20)
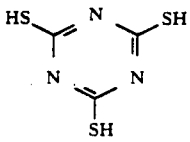
(V-21)
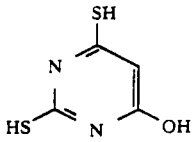
(V-22)
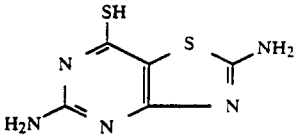
(V-23)
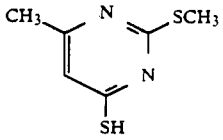
(V-24)
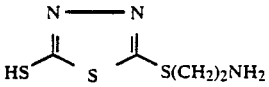
(V-25)
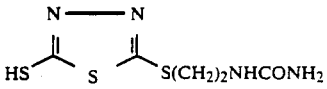
(V-26)
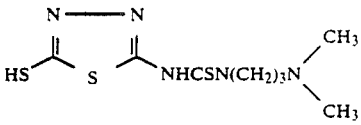
(V-27)
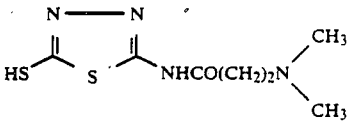
(V-28)
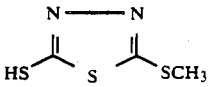
(V-29)
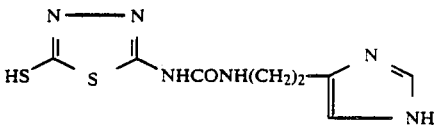
(V-30)
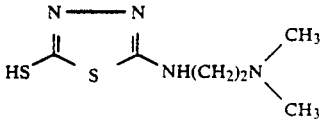
(VI-1)
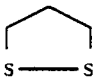

-continued
(VI-2)
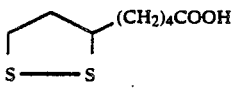
(VI-3)
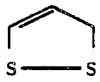
(VI-4)
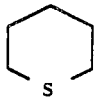
(VI-5)
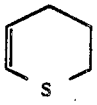
(VI-6)
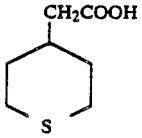
(VI-7)
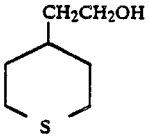
(VI-8)
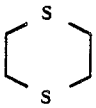
(VI-9)
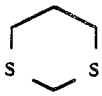
(VI-10)
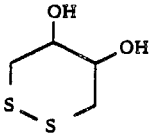
(VI-11)
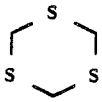
(VI-12)
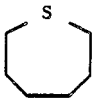
(VI-13)
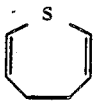
(VI-14)
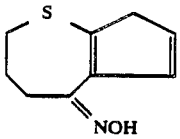
-continued
(VI-15)
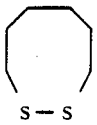
(VI-16)
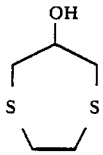
(VI-17)
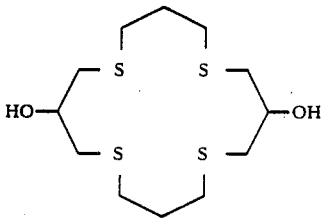
(VII-1)
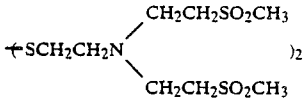
(VII-2)
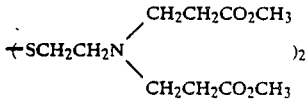
(VII-3)
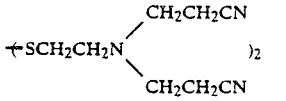
(VII-4)
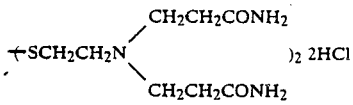
(VII-5)
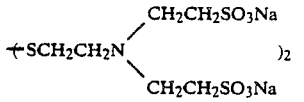
(VII-6)
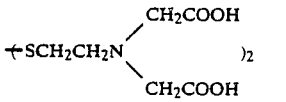
(VII-7)
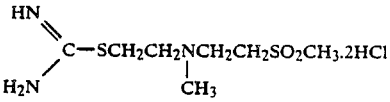
(VII-8)
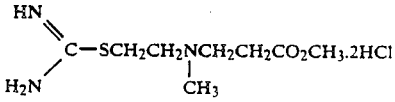
(VII-9)
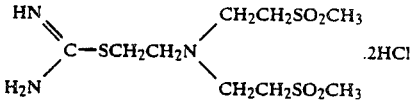

-continued
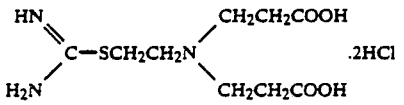
(VII-10)
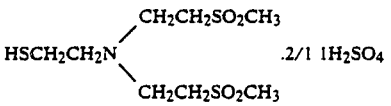
(VII-11)
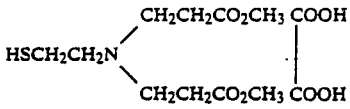
(VII-12)
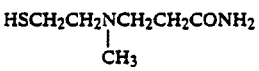
(VII-13)
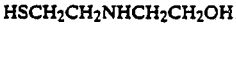
(VII-14)
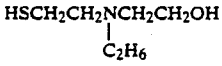
(VII-15)
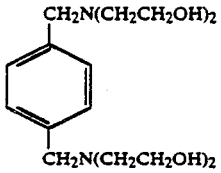
(VIII-1)
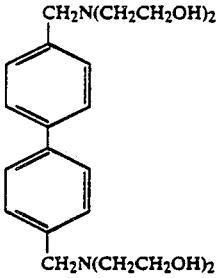
(VIII-2)
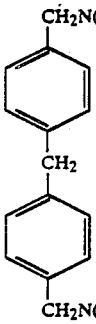
(VIII-3)
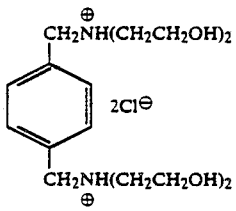
(VIII-4)
-continued
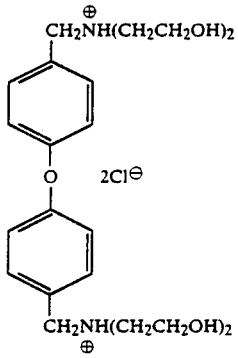
(VIII-5)
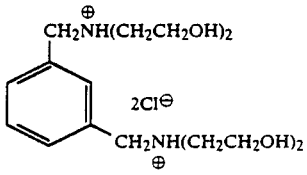
(VIII-6)
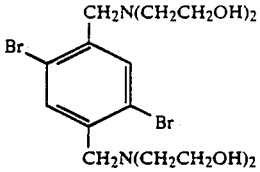
(VIII-7)
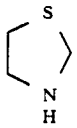
(IX-1)
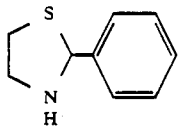
(IX-2)
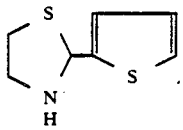
(IX-3)
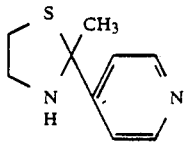
(IX-4)
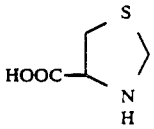
(IX-5)
Imidazoles and the derivatives thereof
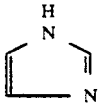
N-1

-continued

N-2

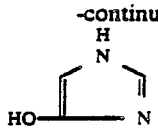

N-3

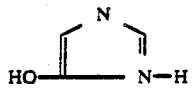

N-4

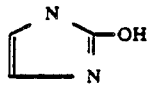

N-5

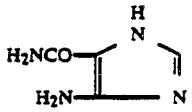

N-6

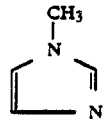

N-7

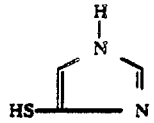

N-8

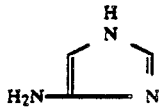

Besides the above-exemplified bleaching accelerators, for example, the following compounds may also similarly be used for.

The exemplified compounds given in Japanese Patent O.P.I. Publication No. 62-123459/1987, pp. 51-115, such as I-2, I-4 to 7, I-9 to 13, I-16 to 21, I-23, I-24, I-26, I-27, I-30 to 36, I-38, II-2 to 5, II-7 to 10, II-12 to 20, II-22 to 25, II-27, II-29 to 33, II-35, II-36, II-38 to 41, II-43, II-45 to 55, II-57 to 60, II-62 to 64, II-67 to 71, II-73 to 79, II-81 to 84, II-86 to 99, II-101, II-102, II-104 to 110, II-112 to 119, II-121 to 124, II-126, II-128 to 144, II-146, II-148 to 155, II-157, III-4, III-6 to 8, III-10, III-11, III-13, III-15, to 18, III-20, III-22, III-23, III-25, III-27, III-29 to 32, III-35, III-36, IV-3, IV-4, V-3 to 6, V-8 to 14, V-16 to 38, V-40 to 42, V-44 to 46, V-48 to 66, V-68 to 70, V-72 to 74, V-76 to 79, V-81, V-82, V-84 to 100, V-102 to 108, V-110, V-112, V-113, V-116 to 119, V-121 to 123, V-125 to 130, V-132 to 144,, V-146 to 162, V-164 to 174, V-176 to 184, VI-4, VI-7, VI-10, VI-12, VI-13, VI-16, VI-19, VI-21, VI-22, VI-25, VI-27 to 34, VI-36, VII-3, VII-6, VII-13, VII-19 and VII-20; those given in Japanese Patent O.P.I. Publication No. 63-17445/1988, pp. 22-25, such as III-2 to 3, III-5 to 10, III-12 to 45, III-47 to 50, III-52 to 54, III-56 to 63 and III-65; and so forth.

They may be used independently or in combination and when they are generally used in an amount within the range of from about 0.01 to 100 g per liter of a bleaching solution or a bleach-fixer, an excellent result may be obtained. From the viewpoints of obtaining a bleach-acceleration effect and preventing a photographic light-sensitive material from staining, they should be used in an amount of, preferably, from 0.05 to 50 g per liter of the bleaching solution or the bleach-fixer used and, more preferably, from 0.05 to 15 g.

When such bleaching accelerator is added into a bleaching solution or a bleach-fixer, it may be added as it is and then dissolved therein. It is usual to add it after dissolving it in advance in water, an alkaline solution, an organic acid or the like. If required, it may also be added therein after it is dissolved with an organic solvent such as methanol, ethanol, acetone or the like.

Such bleaching solutions may be used at a pH value of from 0.2 to 8.0, preferably, from not lower than 2.0 to not higher than 7.0 and, more preferably, from not lower than 4.0 to not higher than 6.5, and at a processing temperature of from 20° C. to 45° C. and, more preferably, from 25° C. to 42° C.

Such bleaching solution is usually used by adding a halide such as ammonium bromide therein.

The bleaching solutions each are also allowed to contain a pH buffer comprising a variety of salts, independently or in combination, such as boric acid, borax, sodium hydroxide, potassium hydroxide, sodium carbonate, potassium carbonate, sodium bicarbonate, potassium bicarbonate, acetic acid, sodium acetate, ammonium hydroxide and so forth. Further, the bleaching solutions are allowed to contain a variety of optical brightening agents, defoaming agents, surface active agents and antimolding agents.

Fixers and bleach-fixers should inevitably contain the so-called fixing agents.

The fixing agents include a compound capable of producing a water-soluble complex salt upon reaction with a silver halide. The compounds include, for example, thiosulfates such as potassium thiosulfate, sodium thiosulfate and ammonium thiosulfate; thiocyanates such as potassium thiocyanate, sodium thiocyanate and ammonium thiocyanate; thiourea; thioether; and so forth.

Besides the above-given fixing agents, the fixers and the bleach-fixers are also allowed to contain, independently or in combination, sulfites such as ammonium sulfite, potassium sulfite, ammonium bisulfite, potassium bisulfite, sodium bisulfite, ammonium metabisulfite, potassium metabisulfite, sodium metabisulfite and so forth, or pH buffers comprising a variety of salts such as boric acid, borax, sodium hydroxide, potassium hydroxide, sodium carbonate, potassium carbonate, sodium bicarbonate, potassium bicarbonate, acetic acid, sodium acetate, ammonium hydroxide and so forth.

Those fixers and bleach-fixers are desired to contain a large quantity of alkali halides or ammonium halides as rehalogenized agent including, for example, such as potassium bromide, sodium bromide, sodium chloride, ammonium bromide and so forth. Those fixers and bleach-fixers are also allowed to contain selectively pH buffers such as borates, oxalates, acetates, carbonates, phosphates and so forth, and, alkylamines, polyethylene oxides and so forth which are well-known as the additives to fixers and bleach-fixers.

The above-mentioned fixing agents are used in an amount of not less than 0.1 mol per liter of a processing solution used. From the viewpoint of the achievement of the objects of the invention, they are used in an amount within the range of, preferably, from 0.6 mol to 4 mol, more preferably, from 0.9 mol to 3.0 mol and, further preferably, from 1.1 mol to 2.0 mol.

If required, for the purpose of more activating a bleaching solution or a bleach-fixer, air or oxygen may be blown into a processing bath or a processing replenisher reservoir, or an appropriate oxidizing agent such as hydrogen peroxide, a bromate, a persulfate and so forth may be added.

Fixers and bleach-fixers each may be replenished in an amount of, preferably, not more than 800 ml per sq. meter of a light-sensitive material to be fixed, more preferably, from 20 ml to 650 ml and, further preferably, from 30 ml to 400 ml.

Fixers and bleach-fixers each should preferably contain an iodide such as ammonium iodide, potassium iodide, sodium iodide, lithium iodide or the like in an amount of, preferably, from 0.1 to 10 g/liter, more preferably, from 0.3 to 5 g/liter, further preferably, from 0.5 to 3 g/liter and, most preferably, from 0.8 to 2 g/liter. A processing solution having a fixing capability, such as a fixer or bleach-fixer, should preferably contain a compound represented by the following Formula FA or FB. When using a fixer or bleach-fixer containing the compound, there is an additional effect that very little sludge is produced in processing a small quantity of light-sensitive material over a long period of time.

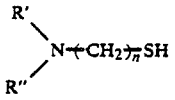

Formula FA wherein R′ and R″ each represent a hydrogen atom, an alkyl group, an aryl group, an aralkyl group or a nitrogen-containing heterocyclic ring; and n′ is an integer of 2 or 3.

The compounds represented by the above-given Formula FA will be typically exemplified.

| No | R′ | R″ | n′ |
|---|---|---|---|
| FA-1 | i-$C_3H_7$— | H | 2 |
| FA-2 | $C_4H_9$— | H | 2 |
| FA-3 | i-$C_4H_9$— | H | 2 |
| FA-4 | sec-$C_4H_9$— | H | 2 |
| FA-5 | t-$C_4H_9$— | H | 2 |
| FA-6 | $CH_2$=$CHCH_2$— | H | 2 |
| FA-7 | $C_6H_{13}$— | H | 2 |
| FA-8 | $C_8H_{17}$— | H | 2 |
| FA-9 | $C_{10}H_{21}$— | H | 2 |
| FA-10 | 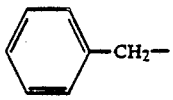 | H | 2 |
| FA-11 | 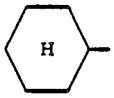 | H | 2 |
| FA-12 | $C_2H_5$— | $C_2H_5$— | 2 |
| FA-13 | $C_3H_7$— | $C_3H_7$— | 2 |
| FA-14 | i-$C_3H_7$— | i-$C_3H_7$— | 2 |
| FA-15 | $C_4H_9$— | $C_4H_9$ | 2 |
| FA-16 | i-$C_4H_9$ | i-$C_4H_9$— | 2 |
| FA-17 | sec-$C_4H_9$ | sec-$C_4H_9$— | 2 |
| FA-18 | $C_6H_{11}$— | $C_6H_{11}$— | 2 |
| FA-19 | i-$C_6H_{11}$— | i-$C_6H_{11}$— | 2 |
| FA-20 | $CH_2$=CH—$CH_2$— | $CH_2$=$CHCH_2$— | 2 |
| FA-21 | $CH_3$— | $CH_3$— | 2 |
| FA-22 | $HOCH_2CH_2$— | H | 2 |
| FA-23 | $HOCH_2CH_2$— | $CH_3$ | 2 |

-continued

| No | R′ | R″ | n′ |
|---|---|---|---|
| FA-24 | 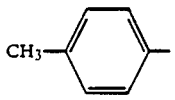 | H | 2 |
| FA-25 | 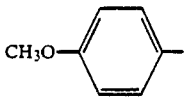 | H | 2 |
| FA-26 | 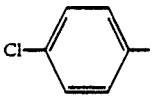 | H | 2 |
| FA-27 | $C_2H_5$— | $CH_3$— | 2 |
| FA-28 | $C_2H_5$— | $C_3H_7$— | 2 |
| FA-29 | H | H | 2 |
| FA-30 | $CH_2$=CH—$CH_2$— | $C_2H_5$ | 2 |
| FA-31 | 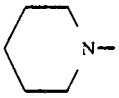 | | 2 |
| FA-32 | 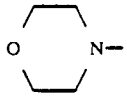 | | 2 |
| FA-33 | 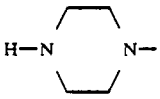 | | 2 |
| FA-34 | 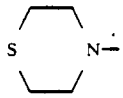 | | 2 |
| FA-35 | 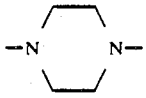 | | 2 |
| FA-36 | 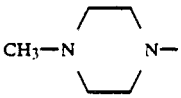 | | 2 |
| FA-37 | $C_2H_5$— | $C_2H_5$— | 3 |
| FA-38 | $HSCH_2CH_2$— | $HSCH_2CH_2$— | 2 |
| FA-39 | $HSCH_2CH_2$— | HOOC—$CH_2$— | 2 |

Those compounds represented by Formula FA may be synthesized in ordinary methods such as those described in, for example, U.S. Pat. Nos. 3,335,161 and 3,260,718.

A series of Compounds FB

FB-1 Thiourea
FB-2 Ammonium iodide
FB-3 Potassium iodide
FB-4 Ammonium thiocyanate
FB-5 Potassium thiocyanate
FB-6 Sodium thiocyanate
FB-7 Thiocyanocatechol Both of the compounds represented by the foregoing Formula FA and the series of Compounds FB may be used independently or in combination. The preferable examples of the combinations thereof include the combinations each of thiourea, ammonium thiocyanate and ammonium iodide; thiourea and ammonium thiocyanate; FA-12 and thiourea: FA-12 and ammonium thiocyanate; FA-12 and ammonium iodide: FA-12 and FA-32; FA-12 and FA-38; and so forth.

When the compounds represented by Formula FA and the series of the compounds FB are each added in an amount within the range of from 0.1 to 200 g per liter of a processing solution, a good result may be obtained. In particular, they are added in an amount within the range of, preferably, from 0.2 to 100 g and, more preferably, from 0.5 to 50 g.

In the invention, when using a processing solution having a fixing function, such as a fixer or a bleach-fixer, the processing time thereof is not longer than 3 minutes 45 seconds in total. Such total processing time should be within the range of, preferably, from 20 seconds to 3 minutes 20 seconds, more preferably, from 40 seconds to 3 minutes and, further preferably, from 60 seconds to 2 minutes 40 seconds.

When usung the same, the bleaching time should be within the range of, preferably, not longer than 1 minute 30 seconds, more preferably, from 10 to 70 seconds and, further preferably, from 20 to 55 seconds. The processing time of the processing solution having a fixing function should be within the range of, preferably, not longer than 3 minutes 10 seconds, more preferably, from 10 seconds to 2 minutes 40 seconds and, further preferably, from 20 seconds to 2 minutes 10 seconds.

It is also preferable to give a forced liquid-agitation to such fixer and bleach-fixer. The agitation is also preferable from the viewpoint of giving a rapid processing aptitude.

The word, 'a forced liquid-agitation' stated herein, does not mean the so-called usual diffusion/transfer of a liquid, but means that a liquid is forcibly agitated by additionally providing a agitating means.

Such forced agitating means include, for example, the following means:

1. A high-pressure spray means or a blowing means,
2. An air-bubbling means,
3. A supersonic oscillating means, and
4. A vibration means.

A pH value of a stabilizer should be within the range of, preferably, from 4.0 to 9.0, more preferably, from 4.5 to 9.0 and, further preferably, from 5.0 to 8.5 for improving an image preservability.

As for the pH controllers which may be contained in a stabilizer, any of alkalizers or acidifyers having been generally known may be used for.

Such stabilizers may be added with organic acid salts such as those of citric acid, acetic acid, succinic acid, oxalic acid, benzoic acid or the like; pH controllers such as phosphates, borates, hydrochloride, sulfates and so forth; surface active agents: antiseptics; metal salts such as those of Bi, Mg, Zn, Ni, Al, Sn, Ti, Zr or the like; and so forth. These compounds may be added in any amount, provided that the pH values of a stabilizing bath may be necessarily maintained and that a color photographic image may be kept stable in preservation and a precipitation may be inhibited from producing. These compounds may also be used in any combinations.

Antimolds preferably applicable to each stabilizer include, for example, a hydroxybenzoate compound, a phenol type compound, a thiazole type compound, a pyridine type compound, a guanidine type compound, a carbamate type compound, a morpholine type compound, a quaternary phosphonium type compound, an ammonium type compound, a urea type compound, an isooxazole type compound, a propanolamine type compound, a sulfamide type compound, an amino acid type compound, an active halogen-releasable compound and a benzotriazole type compound.

Among such antimolds, the preferable ones include, for example, a phenol type compound, a thiazole type compound, a pyridine type compound, a guanidine type compound, a quaternary ammonium type compound, an active halogen-releasable compound and a benzotriazole type compound. The antimolds particularly preferable for liquid preservability include, for example, a phenol type compound, a thiazole type compound, an active halogen-releasable compound and a benzotriazole type compound.

Such antimold is added into a stabilizer in an amount within the range of, preferably, from 0.001 to 50 g per liter of a washless type stabilizer solution used and, more preferably, from 0.005 to 10 g.

From the solutions containing soluble silver salts, such as stabilizers, fixers, bleach-fixers and so forth, silver may be recovered in a variety of silver recovering methods. For example, the effectively applicable silver recovery methods include an electrolysis methods such as that described in French Patent No. 2,299,667; a precipitation method such as those described in Japanese Patent O.P.I. Publication No. 52-73037/1977 and West German Patent No. 2,331,220; 2,548,237; a transmetallation methods such as that described in British Patent No. 1,353,805; and so forth.

Silver may be recovered through an in-line system from a tank processing solution. Or, after the above-mentioned soluble silver salts are recovered from the overflow of a processing solution, silver may then be recovered in the above mentioned method and the residual solution may be discarded as a waste solution. Further, the residual solution may be added with a regenerating agent so as to reuse as a replenisher or a tank processing solution. It is particularly preferable to recover silver after mixing a stabilizer into a fixer or a bleach-fixer.

In this case, it is also allowed to use a process of bringing a stabilizer into contact with an ion-exchange resin, an electrodialysis process, a metal reverse permeation process to which Japanese Patent O.P.I. Publication No. 61-28949/1986 may be referred, and so forth.

The stabilizers each are to be replenished in an amount, preferably, one to 80 times as much as an amount brought from the preceding bath per a unit area of a color photographic light-sensitive material for picture-taking use which is to be processed and, more preferably, 2 to 60 times as much. In a stabilizer solution, a concentration of the components, i.e., a bleach-fixer or fixer, brought from the preceding bath into the stabilizer solution should be, preferably, not more than 1/500 in the final tank of the stabilizing tanks and, more preferably, not mOre than 1/1000. From the viewpoints of diminishing environmental pollutions and keeping the preservability of the stabilizing solution, it is desired to constitute the stabilizing tanks so that the foregoing concentration may be, preferably, from 1/500 to 1/100000 and, more preferably, from 1/2000 to 1/50000.

Such stabilizing tank may be consisted of a plurality of tanks and they should preferably be not less than two tanks but not more than six tanks.

Particularly from the viewpoints of diminishing environmental pollutions and improving an image preservability, it is preferable that the stabilizing tanks should be consisted of not less than two tanks but not more than six tanks and, at the same time, a counter-current system should be provided to a series of the tanks, that is, a system in which a stabilizer is supplied to the consecutive bath and an overflow is supplied from the preceding bath. The number of the tanks should be, preferably, two or three tanks and, more preferably, two tanks.

An amount brought from the preceding bath depends on the types of light-sensitive materials processed, the conveyance speeds and systems of automatic processors used, the systems of squeezing the surface of a light-sensitive material processed, and so forth. In the case of a color film or a roll film, an amount brought therefrom is ordinarily from 50 to 150 ml/m$^2$. A replenishing amount thereof should be within the range of, preferably, from 50 ml/m$^2$ to 4.0 liters/m$^2$ and, more preferably, from 200 to 1500 ml/m$^2$.

In the processes with a stabilizer, a processing temperature should be within the range of, preferably, from 15° to 60° C. and, more preferably, from 20° to 45° C.

EXAMPLES

Typical examples of the invention will be detailed below.

In every example described below, the amounts of the materials added into a silver halide color photographic light-sensitive material will be expressed in terms of square meter of the light-sensitive material, and the amounts of both of silver halides and colloidal silver will be expressed in terms of silver contents.

EXAMPLE-1

(1) Preparation of silver halide emulsions

Into a reaction vessel having contained in advance silver halide seed grains and an aqueous gelatin solution, an aqueous ammoniacal silver nitrate and potassium iodobromide solution (1) and either an aqueous iodobromide solution (2-1) having a lower potassium iodide content than that of Solution (1) or an aqueous potassium bromide solution (2-2) were added in proportion to the grain surface areas being broadened in the course of growing the grains, with controlling the pAg and pH of the contents of the vessel. With keeping an appropriate grain size constant, the adding proportion of either Solution (2-1) or Solution (2-2) to Solution (1) was increased and the solutions were successively added into the vessel. There were some instances where the adding proportion of either Solution (2-1) or Solution (2-2) to Solution (1) was increased two-stepwise. Next, after an aqueous solution of Demol-N manufactured by Kao-Atlas Co. and an aqueous magnesium sulfate solution were added, a precipitation desalting was made. Then, gelatin was added, so that an emulsion having a pAg of 7.8 and pH of 6.0 was obtained. Further to the resulted emulsion, sodium thiosulfate, chloroauric acid and ammonium rhodanate were added and a chemical ripening was carried out. After adding 4-hydroxy-6-methyl-1,3,3a,7-tetraazaindene and 6-nitrobenzimidazole, gelatin was further added, so that a core/shell type silver iodobromide emulsion was obtained.

In the meantime, the core/shell type silver iodobromide emulsion samples EM-1-1 through EM-2-2 such as shown in Table-1 were prepared respectively in such a manner that; the mol percentage of silver iodide was varied by changing the adding proportion of Solution (1) to either Solution (2-1) or Solution (2-2); the grain size was varied by changing the amounts of the ammoniacal silver nitrate and the potassium halide each added; the outermost shell thickness and the intershell thickness were varied by changing the grain size when changing the adding proportion of Solution (1) to either Solution (2-1) or Solution (2-2); and the crystal appearance was varied by changing the pAg in the course of reaction.

Through the electron-microscopic observation, it was found that each of the emulsion samples shown in Table-1 was a monodisperse type emulsion having the average grain size and the variation coefficient of grain size distribution which are also shown in Table-1.

The preparation requirements and the characteristics of each emulsion thus prepared are collectively shown in Table-1.

In the table, Ih, Im and Il indicate the mol percentages of potassium iodide contents of an aqueous potassium halide solution at the stages from the 1st stage to the 3rd stage, respectively. And, Vh, Vm and Vl indicate the volumetric percentages of the shells formed by adding the potassium halides each having the different mol percentages of the above-mentioned potassium iodide contents, respectively.

TABLE 1

| Emulsion sample | IH mol % | Im mol % | Il mol % | ΔI = Ih-Il mol % | ΔI = Ih-Im mol % | ΔI = Im-Il mol % | Total iodide mol % | Volume each shell Vh % | Vm % | V % | Average grain size μm | Variation coefficient % |
|---|---|---|---|---|---|---|---|---|---|---|---|---|
| EM-1-1 | 15 | 5 | 0.3 | 14.7 | 10 | 4.7 | 5.6 | 22 | 39 | 27 | 0.38 | 12 |
| EM-1-2 | 15 | 5 | 0.3 | 14.7 | 10 | 4.7 | 5.6 | 22 | 39 | 27 | 0.55 | 11 |
| EM-2-1 | 40 | 5 | 0.3 | 39.7 | 35 | 4.7 | 11.1 | 22 | 39 | 27 | 0.38 | 18 |
| EM-2-2 | 40 | 5 | 0.3 | 39.7 | 35 | 4.7 | 11.1 | 22 | 39 | 27 | 0.55 | 16 |

Next, Sample No. 1 was prepared by laminating each of the following layers, RL-1, RH-1, IL, GL-1, GH-1, YF, BL-1, BH-1 and Pro, over a support coated with an antihalation layer thereon in order upward from the support.

Amount of each component is expressed by weight per square meter of coating.

RL-1: A low-sensitive layer of red light-sensitive silver halide emulsion layers The low-sensitive layer contains 1.8 g of an emulsion, in terms of silver prepared by color-sensitizing Emulsion EM-1-1 to red-light and a dispersion prepared in such a manner that 0.2 g of 1-hydroxy-4-(isopropylcarbamoylmethoxy-N-[δ-(2,4-di-t-amylphenoxy)butyl]-2-naphthamido (hereinafter called C-1), 0.07 g of disodium 1-hydroxy-4-[4-(1-hydroxy)-8-acetamido-3,6-disulfo-2naphthylazo)phenoxy]-N-[δ-(2,4-di-t-amylphenoxy)butyl]-2-naphth amide (hereinafter called CC-1), 0.8 g of 1-hydroxy-2-[δ-(2,4-di-t-amylphenoxy)-n-butyl]-naphthamide (hereinafter called C-2) and 0.01 g of a DIR compound (hereinafter called D-1) were dissolved into 0.5 g of tricresyl phosphate (hereinafter called TCP), and the resulted solution was dispersed into an aqueous solution containing 1.85 g of gelatin, with emulsifying.

RH-1: A high-sensitive layer of the red light-sensitive silver halide emulsion layers The high-sensitive layer contains 2.0 g of an emulsion prepared by color-sensitizing Emulsion EM-1-2 to red light and a dispersion prepared in such a manner that 0.20 g of cyan coupler C-1 and 0.03 g of colored cyan coupler CC-1 were dissolved into 0.23 g of TCP and the resulted solution was dispersed into an aqueous solution containing 1.2 g of gelatin, with emulsifying.

GL-1: A low-sensitive layer of green light-sensitive silver halide emulsion layers The low-sensitive layer contains an emulsion prepared by color-sensitizing Emulsion 1-1 to green light and a dispersion prepared in such a manner that 0.65 g of 1-(2,4,6-trichlorophenyl)-3-[3-(p-dodecyloxybenzenesulfonamido)benzamido]-5-pyrazolone (hereinafter called M-1), 0.15 g of 1-(2,4,6-trichlorophenyl)-4-(1-naphthylazo)-3-(2-chloro-5-octadecenylsuccinimidoanilino)-5-pyrazolone (hereinafter called CM-1) and 0.03 g of D-1 were dissolved into 0.68 g of TCP, and the resulted solution was dispersed into an aqueous solution containing gelatin, with emulsifying.

GH-1: A high-sensitive layer of the green light-sensitive silver halide emulsion layers The high-sensitive layer contains an emulsion prepared by color-sensitizing EM-1-2 to green light and a dispersion prepared in such a manner that 0.22 g of magenta coupler M-1) and 0.045 g of colored magenta coupler CM-1) were dissolved into 0.27 g of TCP and the resulted solution was dispersed into an aqueous gelatin solution, with emulsifying.

BL-1: A low-sensitive layer of blue light-sensitive silver halide emulsion layers The low-sensitive layer contains an emulsion prepared by color-sensitizing EM-1-1 to blue light and a dispersion prepared in such a manner that 1.2 g of α-pivaloyl-α-(1-benzyl-2-phenyl-3,5-dioxoimidazolidine-4-yl)-2 -chlor-5-[α-dodecyloxycarbonyl)ethoxycarbonyl]acetanilide (hereinafter called Y-1) and 0.01 g of D-1 were dissolved into 0.68 g of TCP, and the resulted solution was dispersed into an aqueous gelatin solution, with emulsifying.

BH-1: A high-sensitive layer of the blue light-sensitive silver halide emulsion layers The high-sensitive layer contains of an emulsion prepared by color-sensitizing EM-1-2 to blue light and a dispersin prepared in such a manner that 0.6 g of yellow coupler Y-1 dissolved into 0.35 g of TCP and the resulted solution was dispersed into an aqueous gelatin solution, with emulsifying.

IL: An interlayer

The interlayer contains 0.8 g of gelatin and 0.07 g of dibutyl phthalate (hereinafter called DBP) in which 0.07 g of 2,5-di-t-octyl hydroquinone (hereinafter called HQ-1) were dissolved.

YF: A yellow filter layer

The yellow filter layer contains 0.15 g of yellow colloidal silver, 0.11 g of DBP in which 0.2 g of an anticolorstaining agent HQ-1 were dissolved, and 1.0 g of gelatin.

Pro: A protective layer

The protective layer contains 2.3 g of gelatin.

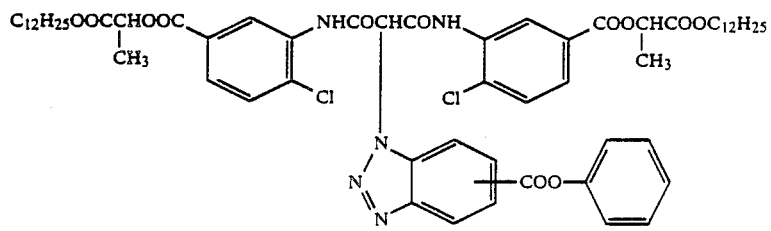

DIR compound D-1

Following the sample thus prepared (hereinafter called Sample No. 1), Samples No. A-1 through No. A-8 were prepared as shown in Table-2A in the same manner as in Sample No. 1, except that the silver halide emulsions, silver contents and gelatin contents each of the layers GL-1 and GH-1 were varied, respectively. Similarly, with respect to the layers BL-1 and BH-1, the same manner as in the above case was applied, so that Samples No. B-1 through B-8 were prepared as shown in Table-2B, respectively.

TABLE 2A (Variations of green light-sensitive layers)

| Sample No. | Sample Emulsion GL-1 | Sample Emulsion GH-1 | Silver halide content (g/m²) | Dried thickness (μm) | Silver density d (g/cm³) |
|---|---|---|---|---|---|
| A-1 | EM-1-1 | EM-1-2 | 3.5 | 5.0 | $7.0 \times 10^{-1}$ |
| A-2 | EM-2-1 | EM-2-2 | 3.5 | 5.0 | $7.0 \times 10^{-1}$ |
| A-3 | EM-1-1 | EM-1-2 | 3.5 | 7.0 | $5.0 \times 10^{-1}$ |
| A-4 | EM-2-1 | EM-2-2 | 3.5 | 7.0 | $5.0 \times 10^{-1}$ |
| A-5 | EM-1-1 | EM-1-2 | 3.5 | 9.0 | $3.9 \times 10^{-1}$ |
| A-6 | EM-2-1 | EM-2-2 | 3.5 | 9.0 | $3.9 \times 10^{-1}$ |
| A-7 | EM-1-1 | EM-1-2 | 5.0 | 5.0 | $10.0 \times 10^{-1}$ |
| A-8 | EM-2-1 | EM-2-2 | 5.0 | 5.0 | $10.0 \times 10^{-1}$ |

TABLE 2B (Variations of blue light-sensitive layers)

| Sample No. | Sample Emulsion BL-1 | Sample Emulsion BH-1 | Silver halide content (g/m²) | Dried thickness (μm) | Silver density d (g/cm³) |
|---|---|---|---|---|---|
| B-1 | EM-1-1 | EM-1-2 | 1.58 | 3.5 | $4.5 \times 10^{-1}$ |
| B-2 | EM-2-1 | EM-2-2 | 1.58 | 3.5 | $4.5 \times 10^{-1}$ |
| B-3 | EM-1-1 | EM-1-2 | 1.58 | 5.0 | $3.15 \times 10^{-1}$ |
| B-4 | EM-2-1 | EM-2-2 | 1.58 | 5.0 | $3.15 \times 10^{-1}$ |
| B-5 | EM-1-1 | EM-1-2 | 1.58 | 7.5 | $2.1 \times 10^{-1}$ |
| B-6 | EM-2-1 | EM-2-2 | 1.58 | 7.5 | $2.1 \times 10^{-1}$ |
| A-7 | EM-1-1 | EM-1-2 | 2.28 | 3.5 | $6.5 \times 10^{-1}$ |
| A-8 | EM-2-1 | EM-2-2 | 2.28 | 3.5 | $6.5 \times 10^{-1}$ |

Next, the other samples were prepared in the same manner as in the above samples, except that the layer arrangements were replaced by the following inverted layer arrangements:

The layers were arranged in order from the lowest layer as follows: namely, BS→RL1→IL→GL-1→IL→BL-1-IL→RH-1→IL→GH-1→YF→BH-1→Pro.

TABLE 3A (Variations of inverted green light-sensitive layers)

| Sample No. | Sample Emulsion GL-1 | Sample Emulsion GH-1 | Silver halide content ($g/m^2$) | Dried thickness (m) | Silver density d ($g/cm^3$) |
|---|---|---|---|---|---|
| C-1 | EM-1-1 | EM-1-2 | 3.5 | 5.0 | $7.0 \times 10^{-1}$ |
| C-2 | EM-1-1 | EM-1-2 | 3.5 | 7.0 | $5.0 \times 10^{-1}$ |
| C-3 | EM-1-1 | EM-1-2 | 3.5 | 9.0 | $3.9 \times 10^{-1}$ |
| C-4 | EM-1-1 | EM-1-2 | 5.0 | 5.0 | $10.0 \times 10^{-1}$ |

TABLE 3B (Variations of inverted blue light-sensitive layers)

| Sample No. | Sample Emulsion BL-1 | Sample Emulsion BH-1 | Silver halide content ($g/m^2$) | Dried thickness (μm) | Silver density d ($g/cm^3$) |
|---|---|---|---|---|---|
| D-1 | EM-1-1 | EM-1-2 | 1.58 | 3.5 | $4.5 \times 10^{-1}$ |
| D-2 | EM-1-1 | EM-1-2 | 1.58 | 5.0 | $3.15 \times 10^{-1}$ |
| D-3 | EM-1-1 | EM-1-2 | 1.58 | 7.5 | $2.1 \times 10^{-1}$ |
| D-4 | EM-1-1 | EM-1-2 | 2.28 | 3.5 | $6.5 \times 10^{-1}$ |

Thus prepared Samples No. B-1 through B-8 and D-1 through D-4, each were exposed to white light through an optical wedge and were then process in the following processing steps.

| Processing step | Processing time | Processing temperature |
|---|---|---|
| <comparative processing> | | |
| Color developing single bath | 3 min. 15 sec. | 38° C. |
| Bleaching single bath | 6 min. 30 sec. | 38° C. |
| Washing single bath | 3 min. 30 sec. | |
| Fixing single bath | 3 min. 15 sec. | 38° C. |
| Double-bath cascade type washing | 3 min. 15 sec. | 38° C. |
| Stabilizing single bath | 1 min. 30 sec. | 38° C. |
| Drying | 2 min. | 40 to 80° C. |
| <Processing of the invention> | | |
| Color developing single bath | 3 min. 15 sec. | 38° C. |
| Bleaching single bath | See Table 4 | See Table 4 |
| Fixing single bath | See Table 4 | See Table 4 |
| Triple-bath cascade type stabilizing | 1 min. | 38° C. |
| Drying | 1 min. | 40 to 80° C. |

The composition of the color developer used therein was as follows.

| | |
|---|---|
| Potassium carbonate | 30 g |
| Sodium hydrogencarbonate | 2.5 g |
| Potassium sulfite | 5 g |

-continued

| | |
|---|---|
| Sodium bromide | 1.3 g |
| Potassium iodide | 2 mg |
| Hydroxylamine sulfate | 2.5 g |
| Sodium chloride | 0.6 g |
| 4-amino-3-methyl-N-ethyl-N-(β-hydroxylethyl)aniline sulfate | 4.8 g |
| Potassium hydroxide | 1.2 g |
| Add water to make | 1 liter |
| Adjust pH with potassium hydroxide or a 20% sulfuric acid solution to be | pH 10.06 |

The composition of the bleaching solution used therein was as follows.

| | |
|---|---|
| Ferric-ammonium ethylenediamine-tetraacetate | 150 g |
| Disodium ethylenediaminetetraacetate | 10 g |
| Ammonium bromide | 150 g |
| Glacial acetic acid | 10 ml |
| The above-given color developer | 200 ml |
| Add water to make | 1 liter |
| Adjust pH with aqueous ammonia or glacial acetic acid to be | pH 5.8 |

The composition of the fixer used therein was as follows.

| | |
|---|---|
| Ammonium thiosulfate | 150 g |
| Sodium bisulfite, anhydrous | 12 g |
| Sodium metabisulfite | 2.5 g |
| Disodium ethylenediaminetetraacetate | 0.5 g |
| Sodium carbonate | 10 g |
| The above-given bleaching solution | 100 ml |
| Add water to make | 1 liter |
| Adjust PH with acetic acid and aqueous ammonia | pH 7.0 |

The composition of the stabilizer used therein was as follows.

| | |
|---|---|
| Formaldehyde in a 37% solution | 2 ml |
| 5-chloro-2-methyl-4-isothiazoline-3-one | 0.05 g |
| Emulgen 810 (Surfactant,) | 1 ml |
| Formaldehyde.sodium bisulfite adduct | 2 g |
| Add water to make | 1 liter |
| Adjust pH with aqueous ammonia or a 50% sulfuric acid solution to be | pH 7.0 |

As shown in the following Table-4-1, the samples were processed by varying the processing periods of time and processing temperatures in the bleaching and fixing steps, and the yellow transmission densities in the unexposed areas of the resulted film samples were then measured. The yellow transmission densities, i.e., the yellow stains, are collectively shown in Table-4-2, in comparison with those obtained from the comparative samples.

TABLE 4-1

| Processing No. | Processing time: Bleaching step | Processing time: Fixing step | Processing time: Total time | Processing temperature: Bleaching step | Processing temperature: Fixing step |
|---|---|---|---|---|---|
| 4-1 | 3 min | 7 min | 10 min | 38° C. | 38° C. |
| 4-2 | 1 min 30 sec | 3 min 30 sec | 5 min | 38° C. | 38° C. |
| 4-3 | 1 min 20 sec | 3 min 10 sec | 4 min 30 sec | 38° C. | 38° C. |
| 4-4 | 1 min 15 sec | 2 min 45 sec | 4 min | 38° C. | 38° C. |
| 4-5 | 1 min 10 sec | 2 min 35 sec | 3 min 45 sec | 38° C. | 38° C. |
| 4-6 | 1 min 05 sec | 2 min 25 sec | 3 min 30 sec | 38° C. | 38° C. |
| 4-7 | 55 sec | 2 min 05 sec | 3 min | 38° C. | 38° C. |
| 4-8 | 45 sec | 1 min 45 sec | 2 min 30 sec | 38° C. | 38° C. |
| 4-9 | 40 sec | 1 min 20 sec | 2 min | 38° C. | 38° C. |

TABLE 4-1-continued

| Processing No. | Processing time: Bleaching step | Processing time: Fixing step | Processing time: Total time | Processing temperature: Bleaching step | Processing temperature: Fixing step |
|---|---|---|---|---|---|
| 4-10 | 35 sec | 55 sec | 1 min 30 sec | 38° C. | 38° C. |
| 4-11 | 35 sec | 55 sec | 1 min 30 sec | 60° C. | 60° C. |
| 4-12 | 45 sec | 1 min 45 sec | 2 min 30 sec | 60° C. | 60° C. |
| 4-13 | 45 sec | 1 min 45 sec | 2 min 30 sec | 50° C. | 50° C. |
| 4-14 | 45 sec | 1 min 45 sec | 2 min 30 sec | 45° C. | 45° C. |
| 4-15 | 45 sec | 1 min 45 sec | 2 min 30 sec | 40° C. | 40° C. |
| 4-16 | 45 sec | 1 min 45 sec | 2 min 30 sec | 35° C. | 35° C. |

TABLE 4-2

| Process No. | Yellow stain: Sample No. B-1 | B-2 | B-3 | B-4 | B-5 | B-6 | B-7 | B-8 | D-1 | D-2 | D-3 | D-4 |
|---|---|---|---|---|---|---|---|---|---|---|---|---|
| 4-1 | 0.13 | 0.13 | 0.13 | 0.13 | 0.13 | 0.13 | 0.13 | 0.13 | 0.14 | 0.14 | 0.14 | 0.14 |
| 4-2 | 0.12 | 0.12 | 0.12 | 0.12 | 0.12 | 0.12 | 0.12 | 0.12 | 0.13 | 0.13 | 0.13 | 0.13 |
| 4-3 | 0.11 | 0.11 | 0.11 | 0.11 | 0.11 | 0.11 | 0.11 | 0.11 | 0.12 | 0.12 | 0.12 | 0.12 |
| 4-4 | 0.09 | 0.10 | 0.10 | 0.10 | 0.10 | 0.10 | 0.09 | 0.09 | 0.11 | 0.11 | 0.11 | 0.10 |
| 4-5 | 0.04* | 0.04* | 0.08 | 0.09 | 0.09 | 0.09 | 0.03* | 0.04* | 0.05* | 0.09 | 0.10 | 0.05* |
| 4-6 | 0.03* | 0.03* | 0.08 | 0.08 | 0.08 | 0.09 | 0.03* | 0.03* | 0.04* | 0.09 | 0.09 | 0.04* |
| 4-7 | 0.03* | 0.03* | 0.08 | 0.08 | 0.08 | 0.08 | 0.03* | 0.03* | 0.03* | 0.08 | 0.09 | 0.03* |
| 4-8 | 0.02* | 0.02* | 0.07 | 0.07 | 0.07 | 0.08 | 0.02* | 0.02* | 0.03* | 0.08 | 0.08 | 0.03* |
| 4-9 | 0.02* | 0.02* | 0.07 | 0.07 | 0.07 | 0.07 | 0.02* | 0.02* | 0.03* | 0.07 | 0.07 | 0.02* |
| 4-10 | 0.02* | 0.02* | 0.07 | 0.07 | 0.07 | 0.07 | 0.02* | 0.02* | 0.02* | 0.07 | 0.07 | 0.02* |
| 4-11 | 0.12 | 0.12 | 0.12 | 0.12 | 0.12 | 0.12 | 0.12 | 0.11 | 0.13 | 0.13 | 0.13 | 0.13 |
| 4-12 | 0.16 | 0.16 | 0.16 | 0.16 | 0.16 | 0.16 | 0.16 | 0.16 | 0.17 | 0.17 | 0.17 | 0.17 |
| 4-13 | 0.12 | 0.12 | 0.12 | 0.12 | 0.12 | 0.12 | 0.12 | 0.12 | 0.13 | 0.13 | 0.13 | 0.13 |
| 4-14 | 0.04* | 0.04* | 0.09 | 0.09 | 0.09 | 0.10 | 0.04* | 0.04* | 0.05* | 0.09 | 0.09 | 0.05* |
| 4-15 | 0.03* | 0.03* | 0.07 | 0.07 | 0.08 | 0.08 | 0.03* | 0.03* | 0.04* | 0.09 | 0.09 | 0.04* |
| 4-16 | 0.02* | 0.02* | 0.06 | 0.06 | 0.07 | 0.07 | 0.02* | 0.02* | 0.03* | 0.08 | 0.08 | 0.03* |

Note *Corresponds to this invention.

From Table-4-2, it is found that the samples having the silver density relating to the invention are excellent, because their yellow stains are very low when the total processing periods of time and processing temperatures both in the bleaching and fixing steps are within the ranges of not longer than 3 minutes 45 seconds and from 20° to 45° C., respectively.

Also, with respect to Samples A-1 through A-8 and C-1 through C-4, the magenta-stains produced therefrom were examined. The results thereof were similarly excellent.

When the graininess and sharpness of the samples were further examined in the following methods, the samples having the silver density relating to the invention were found to be more excellent than the samples having the silver densitys other than those of the invention and also found no lowering in graininess and sharpness in rapid processing.

Sharpness . . . The improvement effects of image sharpness were detected in the manner that MTF (Modulation Transfer Function) values are obtained when a spatial frequency is 10 lines/mm and the resulted MTF values are compared with each other. The more the MTF values are, the more the sharpness is excellent.

Graininess . . . RMS: A standard deviation of the variations of dye-image density values is measured when the dye-images each having a dye-image density of Dmin+0.8 are scanned with a microdensitometer having a circular scanning aperture of 25 μm.

EXAMPLE-2

The color negative film samples B-1 and B-3 which had been prepared in Example-1 were running-processed by making use of the processing solutions used in Example-1 and the following replenisher.

The composition of the color developer replenisher used therein was as follows.

| | |
|---|---|
| Potassium carbonate | 40 g |
| Sodium hydrogencarbonate | 3 g |
| Potassium sulfite | 7 g |
| Sodium bromide | 0.5 g |
| Hydroxylamine sulfate | 3.1 g |
| 4-amino-3-methyl-N-ethyl-N-(β-hydroxylethyl)aniline sulfate | 6.0 g |
| Potassium hydroxide | 2 g |
| Add water to make | 1 liter |
| Adjust pH with potassium hydroxide or a 20% aqueous sulfuric acid solution to be | pH 10.12 |

The composition of the bleaching bath replenisher used therein was as follows.

| | |
|---|---|
| Ferric-ammonium ethylenediaminetetraacetate | 200 g |
| Disodium ethylenediaminetetraacetate | 2 g |
| Ammonium bromide | 178 g |
| Glacial acetic acid | 21 ml |
| Add water to make | 1 liter |
| Adjust pH with aqueous ammonia or glacial acetic acid to be | pH 6.5 |

The composition of the fixer replenisher used therein was as follows.

| | |
|---|---|
| Ammonium thiosulfate | 200 g |
| Sodium bisulfite, anhydrous | 15 g |
| Sodium metabisulfite | 3 g |
| Dosodium ethylenediaminetetraacetate | 0.8 g |
| Sodium carbonate | 14 g |
| Add water to make | 1 liter |
| Adjust pH to be | pH 6.5 |

As for the stabilizer replenisher, the stabilizer used in Example-1 was also used.

| Processing step | Processing time | Processing temperature | Amount replenished |
|---|---|---|---|
| Color developing | 3 min 15 sec | 38° C. | 775 ml |
| Bleaching | 45 sec | 38° C. | 155 ml |
| Fixing | 1 min 45 sec | 38° C. | 790 ml |
| Stabilizing | 50 sec | 38° C. | 775 ml |
| Drying | 1 min. | 40 to 70° C. | — |

(Amounts replenished are expressed in terms of an amount used per sq. meter of light-sensitive materials used.)

In the running process, the processing steps, processing periods of time, processing temperatures and amounts replenished were as follows. T,901

The running process was kept on until the bleaching replenisher was replenished double as much as the capacity of the bleaching tank. After the running process was completed, the yellow stains produced in the unexposed areas and the residual silver in the maximum density area of each samples were measured, respectively.

Next, the same processes were tried as in the above case, except that the ferric-ammonium ethylenediamine tetraacetate contained in the above-mentioned bleaching solution and bleaching replenisher each was replaced by the ferric complex salts of organic acids each having the same mols as shown in the following Table-5. The results thereof are shown in Table-5.

TABLE 5

| Process No. | Ferric-complex of organic acid | Yellow stain Sample B-3 | Yellow stain Sample B-1 |
|---|---|---|---|
| 5-1 | EDTA-Fe | 0.08 | 0.06 |
| 5-2 | PDTA-Fe | 0.07 | 0.02 |
| 5-3 | MEDTA-Fe | 0.07 | 0.03 |
| 5-4 | DTPA-Fe | 0.08 | 0.05 |
| 5-5 | CyDTA-Fe | 0.06 | 0.04 |
| 5-6 | EDTMP-Fe | 0.08 | 0.06 |
| 5-7 | MID-Fe | 0.06 | 0.04 |
| 5-8 | NTMP-Fe | 0.08 | 0.06 |
| 5-9 | EDTA-Fe + PDTA-Fe (EDTA-Fe/PDTA-Fe = 1/2) | 0.07 | 0.02 |
| 5-10 | PDTA-Fe + MID-Fe (PDTA-Fe/MID-Fe = 2/1) | 0.06 | 0.02 |

In the above table, EDTA-Fe represents ferric-ammonium ethylenediaminetetraacetate; PDTA-Fe does ferric-ammonium 1,3-diaminopropanetetraacetate; MEDTA-Fe does ferric-ammonium 1,2-diaminopropanetetraacetate; DTPA-Fe does ferric-ammonium diethylenetriaminepentaacetate; CyDTA-Fe does ferric-ammonium cyclohexanediaminetetraacetate; EDTMP-Fe does ferric-ammonium ethylenediaminetetramethylenephosphonate; MID-Fe does ferric-ammonium methyliminodiacetate; and NTMP-Fe does ferric-ammonium nitrilotrimethylenephosphonate; respectively. Also, in the Table, EDTA-Fe+PDTA-Fe (EDTA-Fe/PDTA-Fe=1/2) means that EDTA.Fe and PDTA.Fe were used in the form of mixture in a mol ratio of 1:2.

From the above-given Table-5, it is found that the effects of the invention can be promoted also when PDTA.Fe is used in the bleaching agents represented by the foregoing Formula A.

Also, the effects of the invention can be displayed when the ferric-ammonium complex salt of A-4, A-7 and A-6 are used instead of MEDTA-Fe that is the bleaching agent used in Process No. 5-3.

Further, the effects of the invention can be displayed in the following cases; namely, a case where the bleaching replenisher used in Process No. 5-2 was added with the bleaching accelerators, I-1, II-2, II-15, II-24, II-27, III-3, III-13 through III-15, IV-1, V-9, V-10, V-13, VI-1, VII-8, VIII-1, VIII-2, VIII-4, VIII-5, IX-1, N-1 and N-2 each in an amount of 1.5 g/liter; another case where both of a fixer and a fixing replenisher are added with the compounds FA-1, FA-12, FA-22, FA-32, FA-35, FA-38, FB-1 and FB-4 each in an amount of 40 g/liter; and a further case where both of the fixer and fixing replenisher each used in Process No. 5-1 are added with ferric-ammonium complex salt of A-1 in an amount of 100 g/liter and the same process as in Process No. 5-1 is carried out after the pH of the resulted solution is adjusted to be 7.0.

What is claimed is:

1. A method of forming color photographic images comprising imagewise exposing a silver halide color photographic light-sensitive material, developing said light-sensitive material with a color developer, bleaching said light-sensitive material with a bleaching solution, immediately after said developing step, and treating said light-sensitive material, after said bleaching, with a bath having a fixing capability, wherein said steps of bleaching and treating with a bath having a fixing capability are carried out for a total time of not more than 3 minutes 45 seconds at a temperature of 20° C. to 45° C.; and said light-sensitive material comprises at least one silver halide emulsion layer containing negative type monodispersed silver halide grains having a variation coefficient of not more than 20 percent, and consisting substantially of silver bromide and/or silver iodobromide; and satisfying at least one of the following requirements (1) and (2);

(1) a blue light-sensitive silver halide emulsion layer included in said silver halide emulsion layers has a dry thickness of 1.0 um to 3.8 um and a silver density (d) of 0.4 g/cm$^3$ to 2.0 g/cm$^3$ (2) a green light-sensitive silver halide emulsion layer included in said silver halide emulsion layer has a dry thickness of 1.5 um to 5.7 um and a silver density (d) of 0.6 g/cm$^3$ to 2.0 g/cm$^3$, wherein silver density (d) is defined by the following formula;

$$d=N/V$$

wherein, N is the silver content of said silver halide layer in grams, and V is the volume of said silver halide emulsion in cc.

2. The method of claim 1, wherein a silver iodide content of said negative type silver halide emulsion is not more than 30 mol %.

3. The method of claim 2, wherein said silver iodide content is 1 mol % to 20 mol %.

4. The method of claim 1, wherein said step of developing is carried out for a time of not more than 180 seconds.

5. The method of claim 1, wherein said color developer contains an aromatic primary amine type color developing agent in an amount of not less than $1.5\times10^{-2}$ mol per liter of said color developer.

6. The method of claim 1, wherein said bleaching solution contains a ferric complex salt of a compound represented by the following formula A;

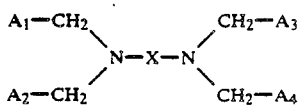

wherein $A_1$ through $A_4$ each represent a $-CH_2OH$ group, a $-COOM$ group or a $-PO_3M_1M_2$ group and may be the same as or the different from each other; and M, $M_1$ or $M_2$ each represent a hydrogen atom, a sodium atom, a potassium atom or an ammonium group, respectively; and X represents a substituted or unsubstituted alkylene group having 3 to 5 carbon atoms.

7. The method of claim 6, wherein said ferric complex salt is contained in said bleaching solution in an amount of from 0.002 mole to 0.4 mol per liter of said bleaching solution.

8. The method of claim 7, wherein said ferric complex salt is contained in said bleaching solution in an amount of from 0.01 mol to 0.3 mol per liter of said bleaching solution.

9. The method of claim 1, wherein a time of said bleaching and treating with a bath having a fixing capability is within the range of from 20 seconds to 3 minutes 20 seconds.

10. The method of claim 9, wherein a time of said bleaching and treating with a bath having a fixing capability is within the range of from 60 seconds to 2 minutes 40 seconds.

* * * * *